US006507320B2

(12) United States Patent
Von Stein et al.

(10) Patent No.: US 6,507,320 B2
(45) Date of Patent: Jan. 14, 2003

(54) CROSS SLOT ANTENNA

(75) Inventors: Ofira M. Von Stein, Madeira Beach, FL (US); Daniel J. Butensky, New Port Richey, FL (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/832,577

(22) Filed: Apr. 11, 2001

(65) Prior Publication Data

US 2002/0044098 A1 Apr. 18, 2002

Related U.S. Application Data

(60) Provisional application No. 60/196,882, filed on Apr. 12, 2000.

(51) Int. Cl.[7] ..... H01Q 13/10
(52) U.S. Cl. ..... 343/770; 343/767; 343/768
(58) Field of Search ..... 343/767, 768, 343/770, 700 MS; H01Q 13/10

(56) References Cited

U.S. PATENT DOCUMENTS

| | | | | |
|---|---|---|---|---|
| 3,320,556 A | | 5/1967 | Schneider | 333/34 |
| 3,419,813 A | | 12/1968 | Kamnitsis | 330/30 |
| 4,214,217 A | | 7/1980 | Saito et al. | 334/45 |
| 4,254,386 A | | 3/1981 | Nemit et al. | 333/128 |
| 4,310,814 A | | 1/1982 | Bowman | 333/121 |
| 4,394,633 A | | 7/1983 | Klein | 333/238 |
| 4,614,922 A | | 9/1986 | Bauman et al. | 333/161 |
| 4,647,880 A | | 3/1987 | Argaman | 333/164 |
| 4,772,864 A | | 9/1988 | Otto et al. | 333/238 |
| 4,916,457 A | | 4/1990 | Foy et al. | 343/770 |
| 4,945,319 A | | 7/1990 | Wilson | 333/33 |
| 4,958,165 A | * | 9/1990 | Axford et al. | 343/770 |
| 4,987,377 A | | 1/1991 | Gray et al. | 330/54 |
| 5,021,755 A | | 6/1991 | Gustafson | 333/128 |
| 5,030,935 A | | 7/1991 | Williams et al. | 333/246 |
| 5,187,490 A | * | 2/1993 | Ohta et al. | 343/770 |
| 5,200,719 A | | 4/1993 | Margulis et al. | 333/34 |
| 5,293,175 A | | 3/1994 | Hemmie et al. | 343/795 |

(List continued on next page.)

FOREIGN PATENT DOCUMENTS

| | | | |
|---|---|---|---|
| EP | 0 317 414 A1 | 5/1989 | H01Q/21/24 |
| EP | 0 508 662 A2 | 10/1992 | H01P/5/12 |
| EP | 0 801 433 A1 | 10/1997 | H01P/3/08 |
| EP | 1 022 803 A | 7/2000 | H01Q/9/04 |
| JP | 63281502 | 11/1988 | H01P/5/08 |

OTHER PUBLICATIONS

Gianvittorio, John P. and Rahmat–Samii, Yahya, "*Fractal Loop Elements in Phased Array Antennas: Reduced Mutual Coupling and Tighter Packing*", IEEE 0–7803–6345–0/00, 2000, pp. 315–318.

(List continued on next page.)

*Primary Examiner*—Hoanganh Le
(74) *Attorney, Agent, or Firm*—Baker Botts L.L.P.

(57) ABSTRACT

A cross slot broad band antenna comprises a five layer configuration including a radiating element cross slot layer having a plurality of radiating slots. Positioned adjacent one side of the radiating element layer is a first spacer layer configured to define a cavity. An S-line feed layer having feeds equal in number to the plurality of radiating slots is positioned adjacent to the first spacer layer. A second spacer layer is positioned adjacent the S-line feed layer and is configured to define a cavity. The fifth layer, a ground plane layer, has a copper clad surface and is positioned adjacent the second spacer layer.

15 Claims, 29 Drawing Sheets

U.S. PATENT DOCUMENTS

| | | | | | |
|---|---|---|---|---|---|
| 5,444,453 | A | | 8/1995 | Lalezari | 343/700 MS |
| 5,471,181 | A | | 11/1995 | Park | 333/246 |
| 5,581,266 | A | | 12/1996 | Peng et al. | 343/770 |
| 5,712,607 | A | | 1/1998 | Dittmer et al. | 333/238 |
| 5,760,744 | A | | 6/1998 | Sauer | 343/700 MS |
| 5,767,808 | A | | 6/1998 | Robbins et al. | 349/700 |
| 5,789,997 | A | | 8/1998 | Dekker | 333/127 |
| 5,872,545 | A | * | 2/1999 | Rammos | 343/770 |
| 5,914,695 | A | | 6/1999 | Liu et al. | 343/795 |
| 5,946,794 | A | | 9/1999 | Koizumi et al. | 29/600 |
| 6,081,988 | A | | 7/2000 | Pluymers et al. | 29/601 |
| 6,140,975 | A | | 10/2000 | Cohen | 343/846 |
| 2002/0044098 | A1 | | 4/2002 | Von Stein et al. | 343/770 |

OTHER PUBLICATIONS

"*Fractal Cross Slot Antenna*", Specification, Claims, and Abstract (25 pages), 6 pages of drawings, inventor Steven D. Eason, filed May 14, 2002, Attorney Docket No. 064750.0449.

U.S. patent application Ser. No. 09/548,691, filed Apr. 13, 2000, entitled "*Suspended Transmission Line and Method*", inventors Sherman, et al, 25 pages of specification, claims and abstract, 2 pages of drawings, Attorney Docket No. 064750.0258.

U.S. patent application Ser. No. 09/548,686, filed Apr. 13, 2000, entitled "*Suspended Transmission Line with Embedded Signal Channeling Device*", inventors Sherman, et al, 30 pages of specification, claims and abstract, 5 pages of drawings, Attorney Docket No. 064750.0259.

U.S. patent application Ser. No. 09/548,467, filed Apr. 13, 2000, entitled "*Suspended Transmission Line with Embedded Amplifier*", inventors Sherman, et al, 38 pages of specification, claims and abstract, 7 pages of drawings, Attorney Docket No. 064750.0260.

U.S. patent application Ser. No. 09/548,578, filed Apr. 13, 2000, entitled "*Integrated Broadside Conductor for Suspended Transmission Line and Method*", inventors Sherman, et al, 25 pages of specification, claims and abstract, 2 pages of drawings, Attorney Docket No. 064750.0423.

U.S. patent application Ser. No. 09/548,689, filed Apr. 13, 2000, entitled "*Method for Fabricating Suspended Transmission Line*", inventors Sherman, et al, 23 pages of specification, claims and abstract, 2 pages of drawings, Attorney Docket No. 064750.0424.

Mosko, United States Statutory Invention Registration H27, "*Integrable Broadside Power Divider*," filed Sep. 3, 1985, published Feb. 4, 1986.

M. Saito, et al, XP–002172854, "*UHF TV Tuner Using PC Board with Suspended Striplines*," IEEE Transactions on Consumer Electronics, vol. CE–24, No. 4, Nov. 1978, pp. 553–559.

Peter, R., et al, "*High–Performance HEMT Amplifiers with a Simple Low–Loss Matching Network*," IEEE Transactions on Microwave Theory and Techniques, vol. 39, Sep. 1, 1991, No. 9, New York, US, pp. 1673–1675.

PCT International Search Report dated Aug. 6, 2001 for PCT/US01/11410 filed Apr. 6, 2001.

Pozar, D.M., *Microwave Engineering*, John Wiley & Sons, Inc., Second Edition, pp. 363–368, 1998.

Wilkinson, E.J., "An N–Way Hybrid Power Divider," IRE Transactions on Microwave Theory and Techniques, vol. MTT–8, No. 1, pp. 116–118. Jan. 1960.

Saleh, A.A.M., "Planar Electrically Symmetric n–Way Hybrid Power Dividers/Combiners," IEEE Transactions on Microwave Theory and Techniques, vol. MTT–28, No. 6, pp. 555–563, Jun., 1980.

Green, H.E., "The Numerical Solution of Some Important Transmission–Line Problems," IEEE Transactions on Microwave Theory and Techniques, vol. MTT–13, No. 5, pp. 676–692, Sep. 1965.

Fromm, W.E., "Characteristics and Some Applications of Stripline Components," IEEE Transactions on Microwave Theory and Techniques, vol. MTT–3, No. 2, pp. 13–19, Mar., 1955.

Saleh, A.A.M., Computation of the Frequency Response of a Class of Symmetric N–Way Power Dividers, Bell System Technical Journal, vol. 59, No. 8, pp. 1493–1512, Oct., 1980.

* cited by examiner

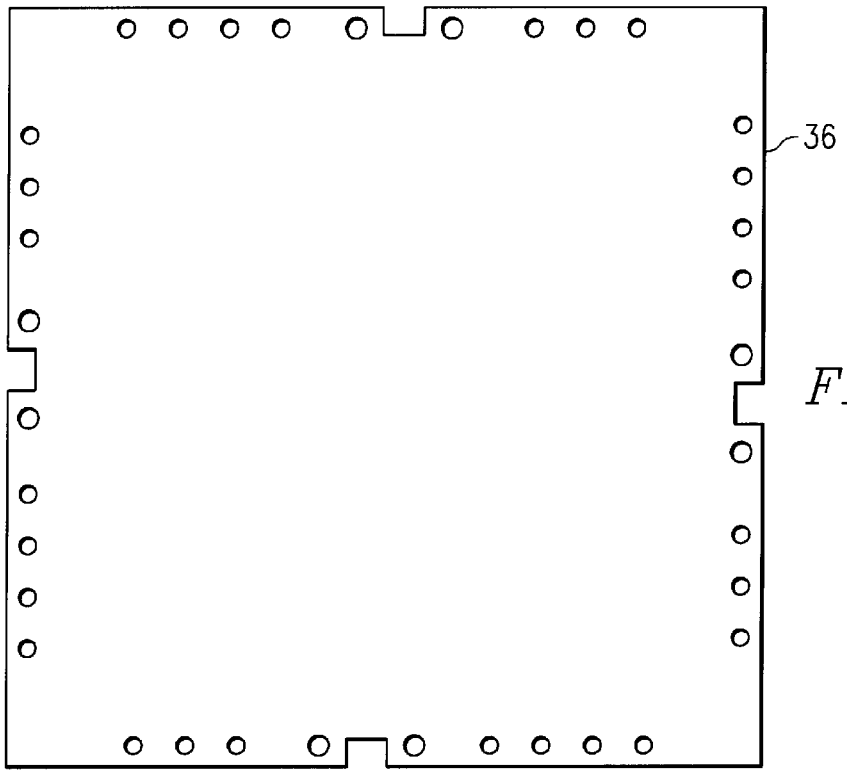
FIG. 2E
FIG. 3
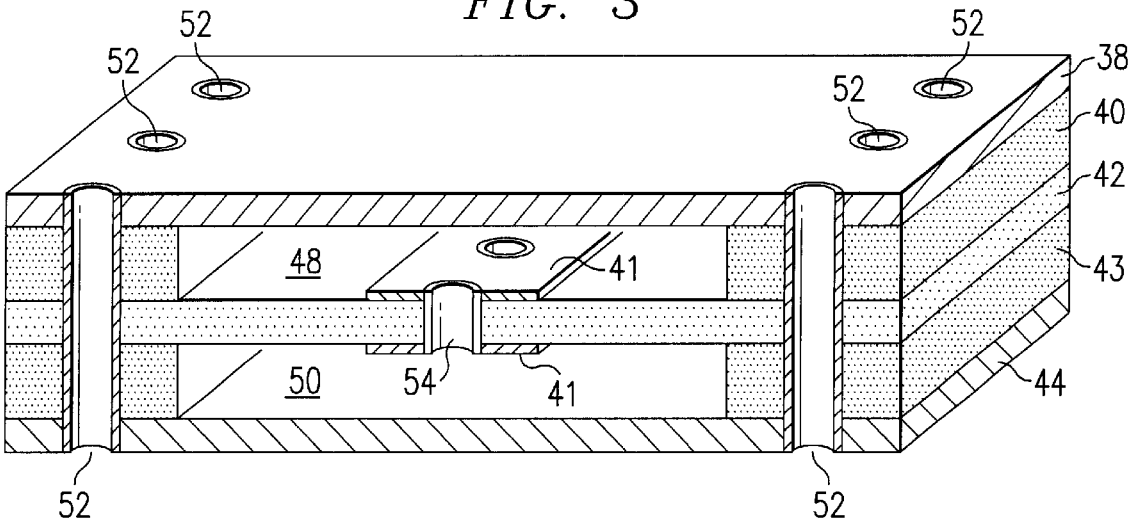

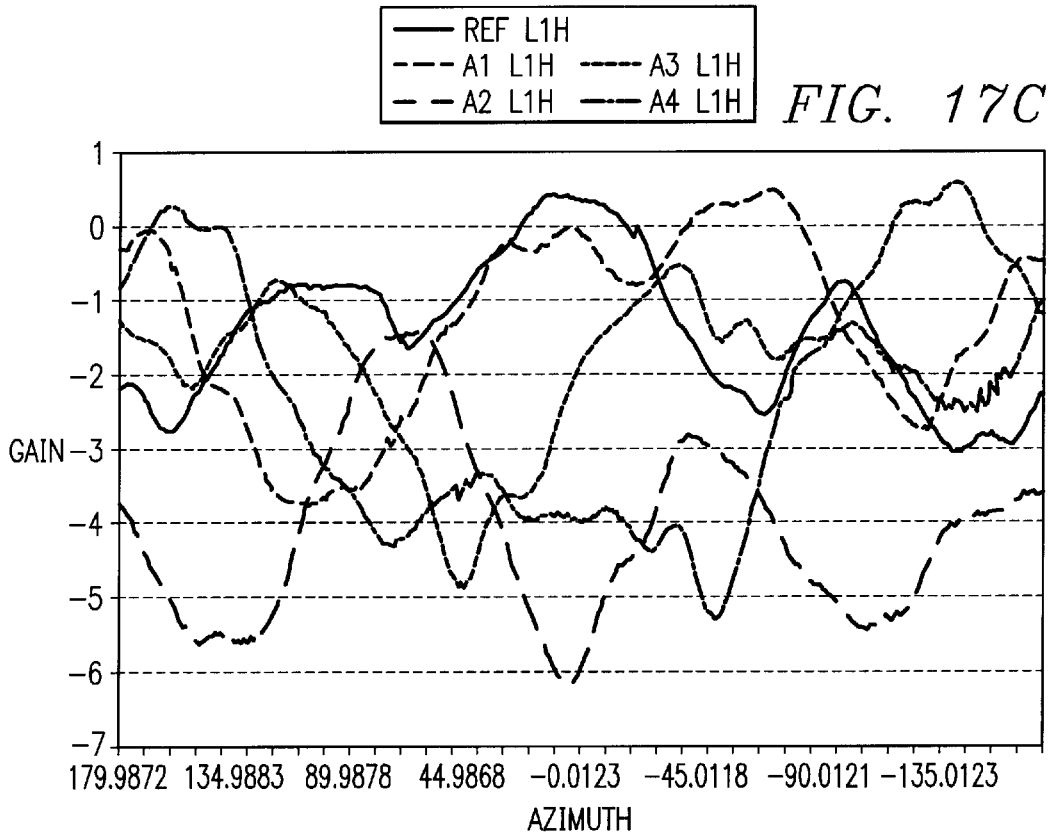
FIG. 17C
FIG. 18A
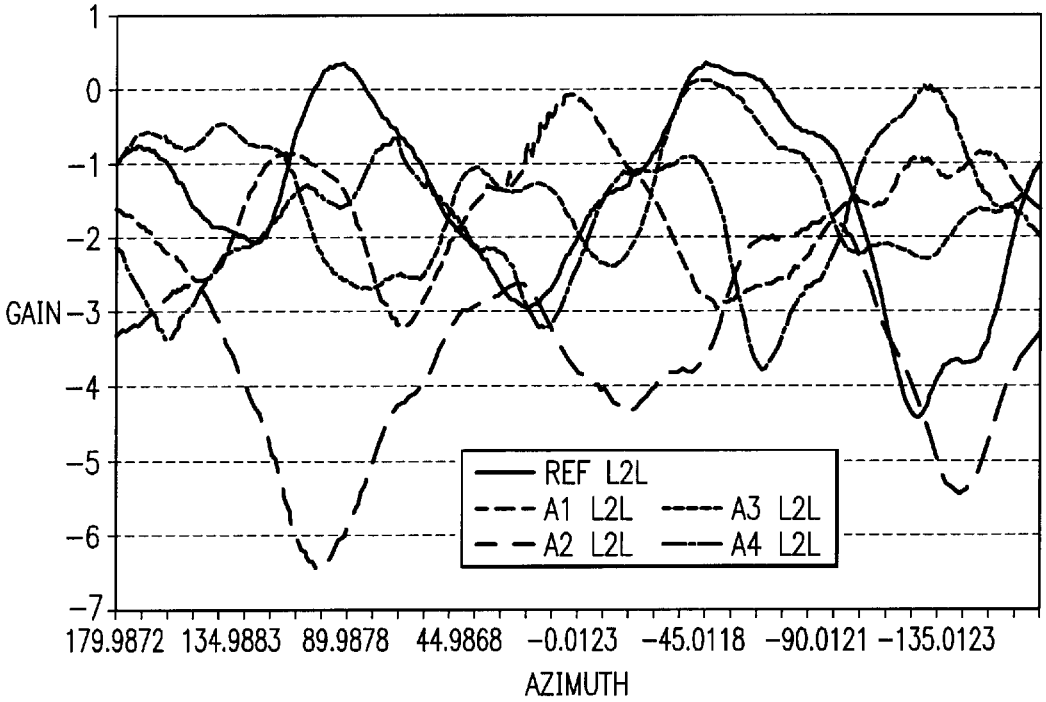

CROSS SLOT ANTENNA

RELATED APPLICATION

This application claims the benefit of U.S. provisional application Serial No. 60/196,882, filed Apr. 12, 2000, entitled S-line Cross Slot Antenna.

TECHNICAL FIELD OF THE INVENTION

This invention relates to a cross slot antenna, and more particularly to a cross slot antenna incorporating an S-line feed.

BACKGROUND OF THE INVENTION

There is a continuing need for GPS antennas (FRPA, GAS-1, CRPA, etc.) to compete for low cost, low weight GPS antennas while not compromising performance, and also a configuration that easily lends itself for providing a variety of implementations such as a single element, an antenna array, as well as a conformal antenna.

Antenna elements for circular polarization (CP) have traditionally been fabricated using expensive microwave substrate materials such as Duroids (PTFE), Alumina, and TMM. Cross slot antennas for CP have been widely used in L Band for GPS. These antennas are either cavity back antennas with various coupling techniques (wire, posts, etc.) or stripline. In addition to the high cost of using microwave materials the weight is also a significant problem for cavity backed and stripline cross slot antennas. The cost and weight are even more pronounced when integrating the antenna element in an array.

Cross slot antennas in stripline are widely used where a stripline feed network feeds the slots in quadrature. Four stripline feeds are used to couple the energy to each of the legs of the cross slot. This approach is successful for minimizing coupling between feed transmission lines and thus producing improved axial ratio. However, this approach uses expensive microwave materials in order to provide gain and radiation efficiency. The cost for raw material as well as the processing cost for an antenna array is increased significantly. In order to minimize the cost, single elements are fabricated and installed on a ground plane. This approach, although reducing fabrication cost and increasing yield, results in increased weight where in applications such as aircraft and missiles this may not be acceptable.

SUMMARY OF THE INVENTION

The physical characteristics of the S-line transmission structure and excellent electrical performance present an ideal configuration for coupling through a slot. The single slot type of antenna is a variation of the basic dipole antenna. Each side of the slot acts as one node of an elementary dipole. The length and separation dimensions of the slot are selected to maximize performance (fraction of a wavelength).

A cross slot antenna has two orthogonal intersecting crossed slots in a cavity backed conductive element where each leg of each slot is excited by an RF signal from an S-line feed providing four RF inputs of 0°, 90°,180°, and 270° to achieve circular polarization.

The individual elements in an electronically scanned antenna are normally identical, ideally, and have two primary characteristics: (1) the beam of the element should be hemispherical, and (2) the radiation field should be circularly polarized. The criteria of a hemispherical beam enables the antenna array to have a hemispherical coverage, and circular polarization allows operation independent of the antenna orientation. The physical structure of the cross slot antenna is very well suited to array application. The major problem in the design of the cross slot antenna is the method of exciting the slots to obtain the required polarization.

In accordance with one embodiment of the present invention, a cross slot broadband antenna comprises a radiating cross slot layer having a radiating element comprising a plurality of radiating slots. A first spacer layer configured to define a cavity is positioned adjacent one side of the radiating layer wherein the cavity generally outlines the pattern of the plurality of radiating slots. An S-line transmission feed layer having feed transmission lines equal in number to the plurality of radiating slots is positioned adjacent the first spacer layer and a second spacer layer also configured to define a cavity is positioned adjacent to the transmission feed layer. In addition, the cross slot broadband antenna comprises a ground plane layer having a copper clad surface, where the ground plane layer is positioned adjacent the second spacer layer.

Also in accordance with the present invention there is provided a cross slot broadband antenna comprising a radiating cross slot layer having a plurality of radiating elements, each radiating element comprising a plurality of radiating slots to form an array of radiating elements. A first spacer layer configured to define a cavity in proximity to each of the plurality of radiating elements is positioned adjacent one side of the radiating layer. Positioned adjacent the first spacer layer is an S-line transmission feed layer having three transmission lines equal in number to the plurality of radiating slots for each of the plurality of radiating elements. A second spacer layer also configured to define a cavity for each of the plurality of radiating elements is positioned adjacent to the transmission feed layer. Positioned adjacent the second spacer layer is a ground plane layer having a copper clad surface.

Technical advantages of the present invention include providing an S-line cross slot antenna constructed utilizing common, low cost, light and each to process materials relative to the microwave substrates typically utilized. Further, size reduction is a technical advantage along with configuring the antenna to provide flush mounting of the antenna. As a result, the S-line cross slot antenna has superior physical characteristics and electrical performance and presents a new idea of configuration for coupling energy to the slot type antenna.

BRIEF DESCRIPTION OF THE DRAWINGS

A more complete understanding of the cross slot antenna of the present invention may be had by reference to the following detailed description when taken in conjunction with the accompanying drawing.

FIGS. 2*a*, 2*b*, 2*c*, 2*d* and 2*e* are top views of the five layers of the antenna of FIG. 1 including the radiating cross slot layer, a first spacer layer, an S-line feed layer, a second spacer layer, and a ground layer, respectively;

FIG. 3 is a pictorial illustration in section of an S-line, G10 microwave circuit as a feed for each slot of the antenna of FIG. 1;

FIGS. 17*a*, 17*b* and 17*c* illustrate antenna radiation patterns for the five element S-line cross slot antenna of FIG. 6 for 30° at reference L1L, L1M and L1H, respectively;

FIGS. 18*a*, 18*b* and 18*c* illustrate antenna radiation patterns for the five element S-line cross slot antenna of FIG. 6 for 30° at reference L2L, L2M and L2H, respectively;

DETAILED DESCRIPTION OF THE DRAWINGS

Figure 1:
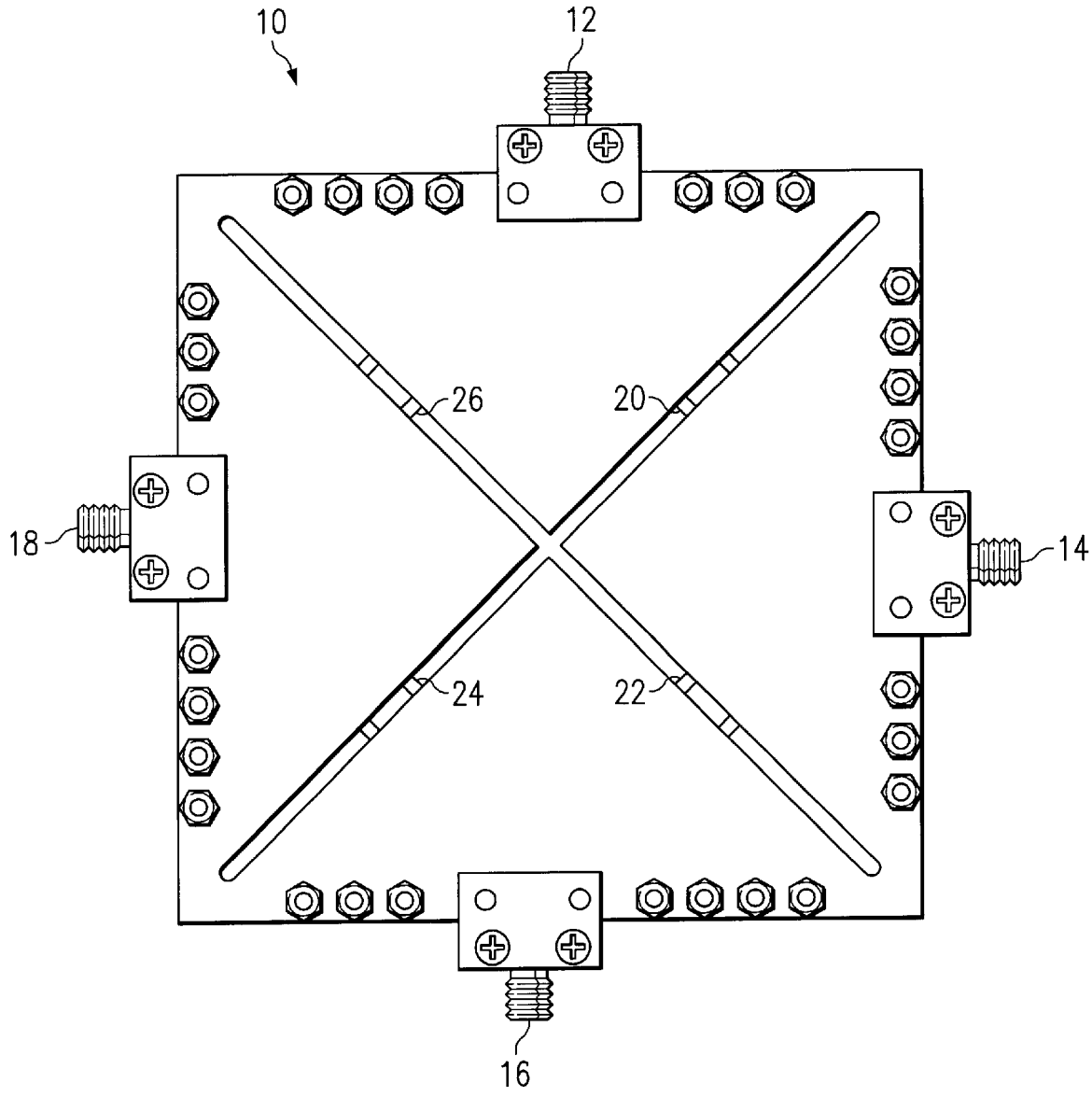
FIG. 1 is a top view of an S-line cross slot antenna incorporating a narrow slot configuration and horizontal launch in accordance with the present invention.

Referring to FIG. 1 there is shown a narrow slot S-line cross slot antenna 10 having horizontal coaxial inputs 12, 14, 16 and 18. The two crossed radiating slots of the antenna 10 have a length dimension at a frequency of L1 of $$\frac{\lambda}{2}.$$

Slot width, length and shape govern the resonant frequency of the antenna where an increase in slot length decreases the resonant frequency. Slot width influences the bandwidth versus radiation efficiency. As illustrated in FIG. 1, the S-line transmission feeds 20, 22, 24 and 26 are coupled at the center of each leg of the cross slots. The S-line transmission feed locations establishes impedance variation of the slot while the S-line width, length and shape impact impedance matching.

Referring to FIGS. 2A–2E, there is shown each of the layers 28, 30, 32, 34 and 36 comprising the antenna of FIG. 1. All of the layers are produced from a low cost material FR4 with the ground layer 36 (the ground plane) having a thickness of 0.032 of an inch and copper clad on the side opposite from the antenna cavity. The radiating cross slot layer 28 has the same dimensions as the ground layer 36 and includes cutouts for the cross slot pattern. The radiating cross slot layer 28 also has a thickness of 0.032 of an inch and is copper clad on the radiating side and is without copper cladding on the antenna cavity side. The layers 30 and 34 are spacer layers with no metalization and do not contribute to the electrical characteristics of the antenna. The spacer layers 30 and 34 control the antenna cavity thickness dimension. The S-line feed layer 32 includes four S-line feed transmissions 20, 22, 24 and 26 that are routed on FR4 material having a thickness of 0.032 of an inch.

The five layers are laminated together with plated through ground vias 52 (see FIG. 3) connecting the layer 28 to the layer 36.

Referring to FIG. 3, there is illustrated a section of an S-line feed for coupling energy to the radiating slots of the antenna of FIG. 1.

S-Line, also referred to as Suspended Via Line, combines the characteristics of low cost and high RF performance in a low weight package. This new type of "transmission line" is built from a unique structure using standard low cost G10 PCB material. The S-Line structure is formed by the lamination of several G10 layers. Two of the layers are routed out prior to lamination to create the air cavities above and below the RF center feed conductor 41. Low insertion loss is maintained at microwave frequencies because of these air cavities. Additional insertion loss reduction comes from the dual center conductor with broadside vias 54.

The S-line cross slot antenna of the present invention uses an S-line feed for coupling energy to the radiating slots. Since S-Line feed is an approach using very inexpensive materials for fabrication with excellent performance at microwave frequencies, the insertion loss in the feed network is a minimum. An S-line feed is composed of a transmission line suspended in air and thus provides a mechanism for coupling to the radiating slots of the antenna of FIG. 1. The present invention allows for a structure that includes S-line feed coupling to a cavity backed (air) cross slot antenna. The antenna displays excellent broad band gain response. The structure is simple in construction where all the layers are composed of FR4 material. Since the antenna of the present invention is an air cavity it is also very light weight. The cost and weight benefits of the antenna structure of the present invention is even more pronounced when implemented in an antenna array of a plurality of radiating elements. Very large panels can be fabricated inexpensively where the boundary for each radiating element is defined by plated through vias 54 that connect the ground plane layer to the radiation layer. The antenna radiating elements and S-line feed network are an integral feature of the whole antenna.

The S-Line feed of FIG. 3 is composed of a transmission line suspended in air with FR4 layers for structural support. It provides excellent electrical characteristics at low cost ordinarily achieved only by using expensive microwave materials (low loss tangent) The S-Line cross slot antenna takes advantage of these characteristics where each feed line for the four slot legs is an S-Line feed. Each S-Line feed couples the input signal to one of the radiating cross slots. The S-line feed with the top and bottom ground plane defining height (ground to ground spacing) also defines the cavity structure for the antenna, i.e. ground plane and radiating plane. The use of S-Line feed for a cavity backed cross slot antenna is an elegant way to achieve a broad band impedance match and radiation efficiency with optimum reduced coupling between feed lines. This superior performance is achieved while maintaining an antenna that is low cost and low weight. The cost and weight benefits are more significant as the antenna array size is increased. The implementation of the S-line feed within the cavity backed antenna using all FR4 layer structure lends itself to adopt to diverse configurations such as a conformal antenna or any configuration aperture.

Referring to FIG. 3, the suspended transmission line includes a support layer 42 supporting a center conductor 41, first and second spacer layers 40 and 43 each disposed on opposite sides of the support layer 42, and first and second plate layers 38 and 44 each disposed outwardly of a corresponding spacer layer 40 or 43. Each of the layers 42, 40, 43, 38, and 44 may be separately fabricated and thereafter laminated together to form the suspended transmission line.

The support layer 42 is a thin dielectric sheet having a first side and an opposite second side. The support layer 42 is preferably minimized to a thickness needed to support the center conductor 41 in order to minimize the cross section of the support layer 42 and thus limit electrical fields in the support layer. The support layer 42 may be continuous or include openings (shown in FIG. 2C but not shown in FIG. 3) to control propagation characteristics of the suspended transmission line, and to allow integration of components directly into the suspended transmission line.

The lossy material of the support layer 42 is an epoxy glass such as G-10 or GFG, polyimide glass, or other suitable printed circuit board base materials such as polyester, or other suitable lossy materials. A lossy material has a moderate loss tangent of about 0.04 or less. In one embodiment, G-10 material is preferred for the support layer 42 because G-10 has good dimensional stability over a large temperature range and is easy to laminate and match to other layers and materials.

The center conductor 41 is supported by the support layer 42 between the first and second plate layers 38 and 44. The first and second plate layers 38 and 44 provide the upper and lower plates to the suspended transmission line. Plate layers 38 and 44 may be solid metal or a base substrate material with metal covering on one surface. The center conductor 41 transmits the signal with low dissipation loss.

The first and second spacer layers 40 and 43 maintain the plate layers 38 and 44 in space relation with the support layer 42, and thus the center conductor 41, to form a propagation structure encompassing the center conductor 41 with air and ground planes for Quasi-TEM mode propagation. The propagation structure encompasses the center conductor 41, including above and/or below the conductor 41 up to and not beyond the upper and lower ground plate layers 38 and 44. The propagation structure provides a low-loss medium for propagation of the electromagnetic field generated by a transmitted signal. Accordingly, dissipation losses are minimized along the suspended transmission line.

The first and second spacer layers 40 and 43 may each be continuous along the propagation structure or comprise a plurality of discrete posts or other suitable structures operable to maintain the plate layers 38 and 44 in space relation from the center conductor 41. The spacer layers 40 and 43 are sized such that substantially all of the electromagnetic field generated by a transmitted signal on the center conductor 41 is maintained in the propagation structure. Thus, spacer geometry is dependent on the transmitted signal frequency as well as the size, geometry, and materials of the support layer 42, center conductor 41, plate layers 38 and 44, and the propagation structure.

The first and second spacer layers 40 and 43 are each fabricated of a dielectric, conductor, or other suitable material. Preferably, the sidewalls of the spacer layers 40 and 43 are spaced apart and away from the center conductor 41 to minimize the effect on the electromagnetic field in the propagation structure. This minimizes the changes in impedance along the direction of propagation. In addition, the spacer layer material preferably has a coefficient of thermal expansion equal or at least similar to the material of the support layer 42 so that the suspended transmission line has good mechanical stability over a large temperature range. In a particular embodiment, the support layer 42 and spacer layers 40 and 43 are each fabricated of G-10 material.

A plurality of mode suppression connectors 52 are positioned on either side of the propagation structure to form the S-feed line and substantially eliminate or reduce interference between the suspended transmission line and nearby or adjacent transmission lines and other devices or circuits in the transmission system. The mode suppression connectors 52 are spaced in accordance with conventional techniques. In one embodiment, the mode suppression connectors 52 are tin plated copper vias extending through the support layer 42 and spacer layers 40 and 43 between the plate layers 38 and 44. The mode suppression connectors 52 are attached to metalization layers for additional mechanical support and improved mode suppression.

Figure 2A:
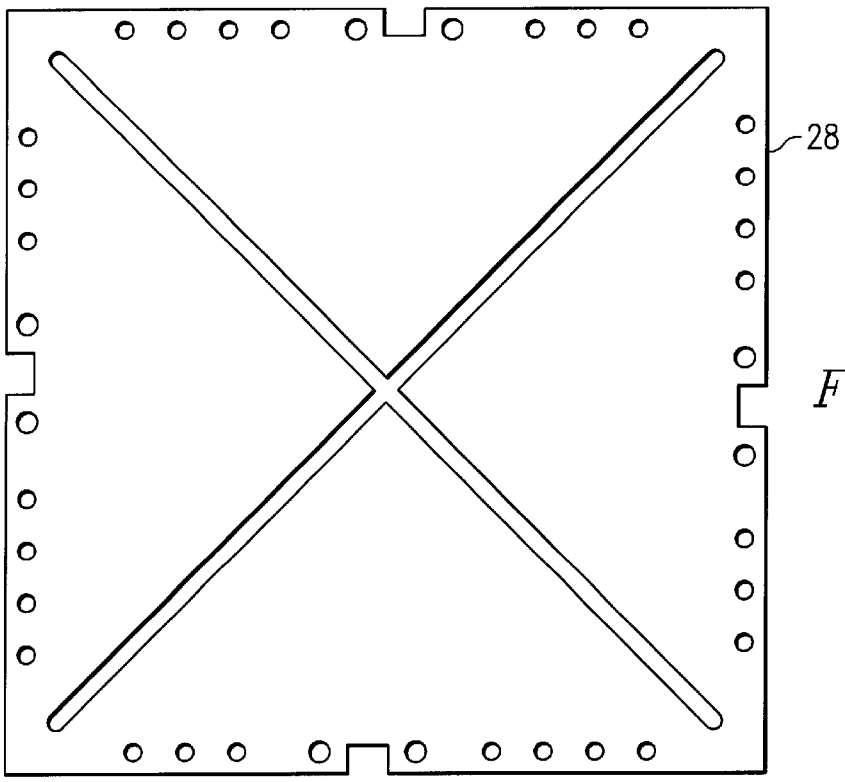
Figure 2B:
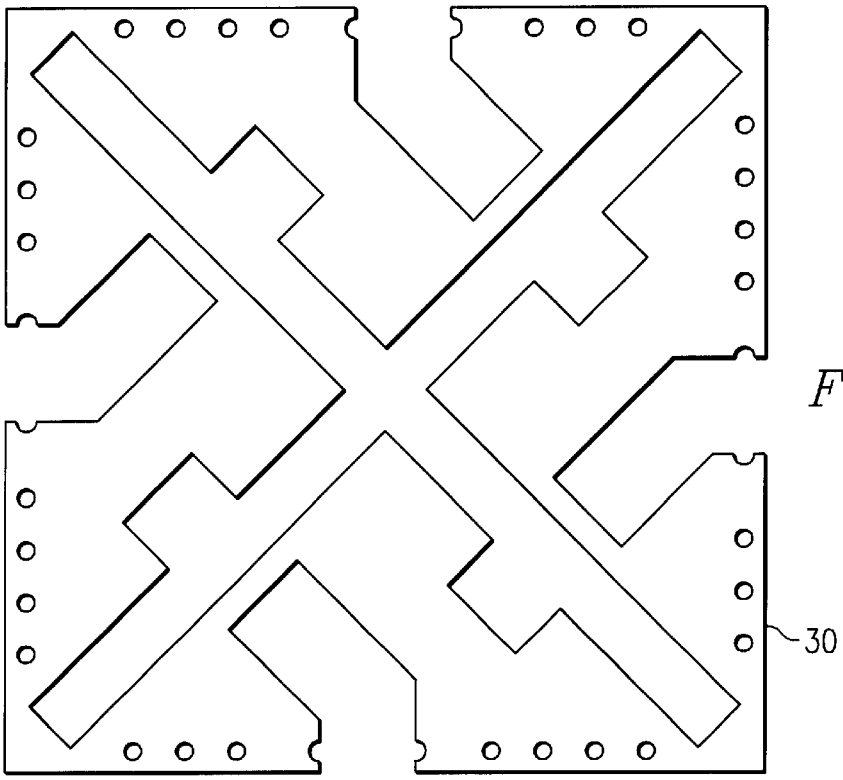
Figure 2C:
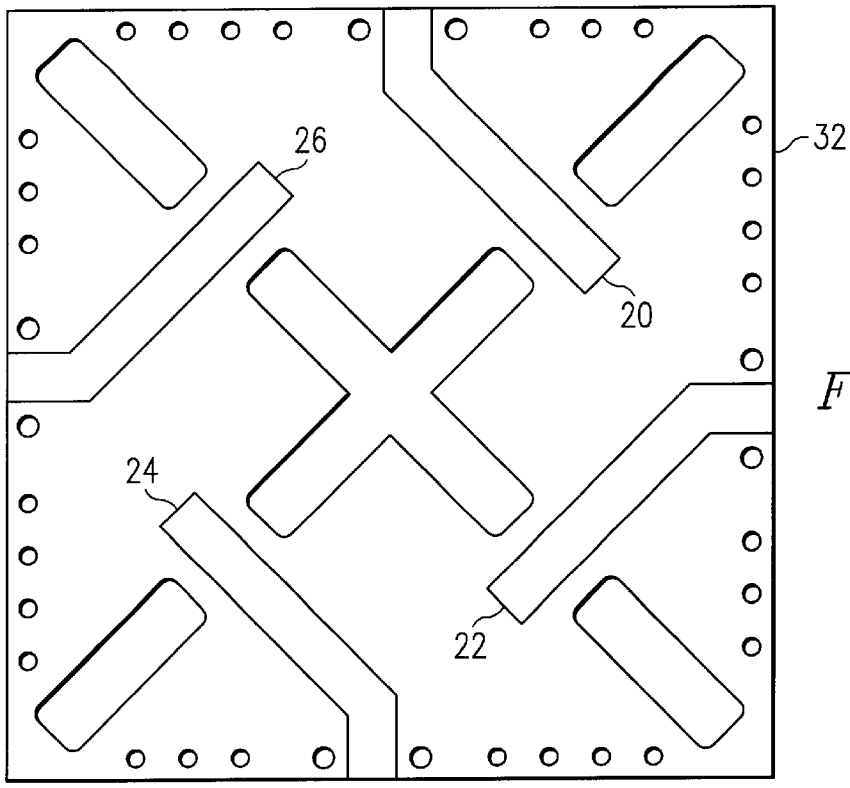
Figure 2D:
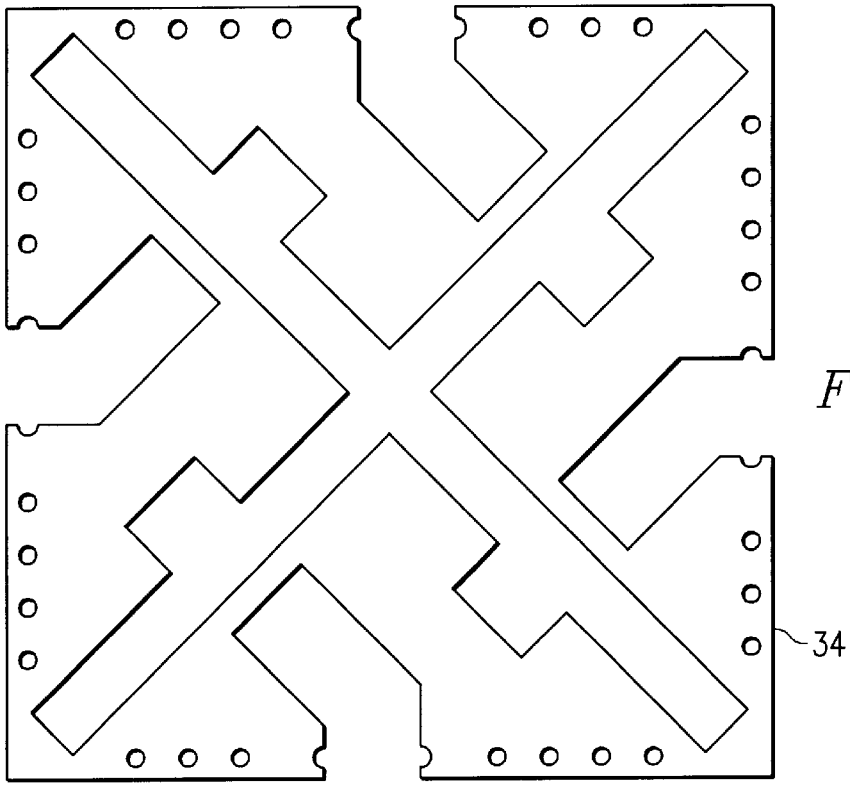

Referring to FIG. 1, FIGS. 2A–E and FIG. 3, the support layer 42 corresponds to the S-line feed layer 32 of FIG. 2C with the center conductor 41 representing the transmission feeds 20, 22, 24 and 26. The radiating cross slot layer 28 of FIG. 2A is represented in FIG. 3 by the first plate 38 and it is the plate 38 that includes the cross slot radiating element as illustrated in FIG. 1. The spacer layers 30 and 34 of FIGS. 2B and 2D, respectively, correspond to the first and second spacer layers 40 and 43, respectively. The patterns illustrated in FIGS. 2B and 2C are illustrated in FIG. 3 by the cavities 48 and 50. With reference to FIG. 2E, the ground layer 36 equates to the second plate layer 44 as illustrated in FIG. 3. Thus, the S-line feed of FIG. 3 represents a cutaway section of the layers 28, 30, 32, 34 and 36 assembled into the antenna of FIG. 1 with the suppression connectors 52 functioning as fasteners to hold the layers 28, 30, 32, 34 and 36 into an antenna structure.

Figure 4:
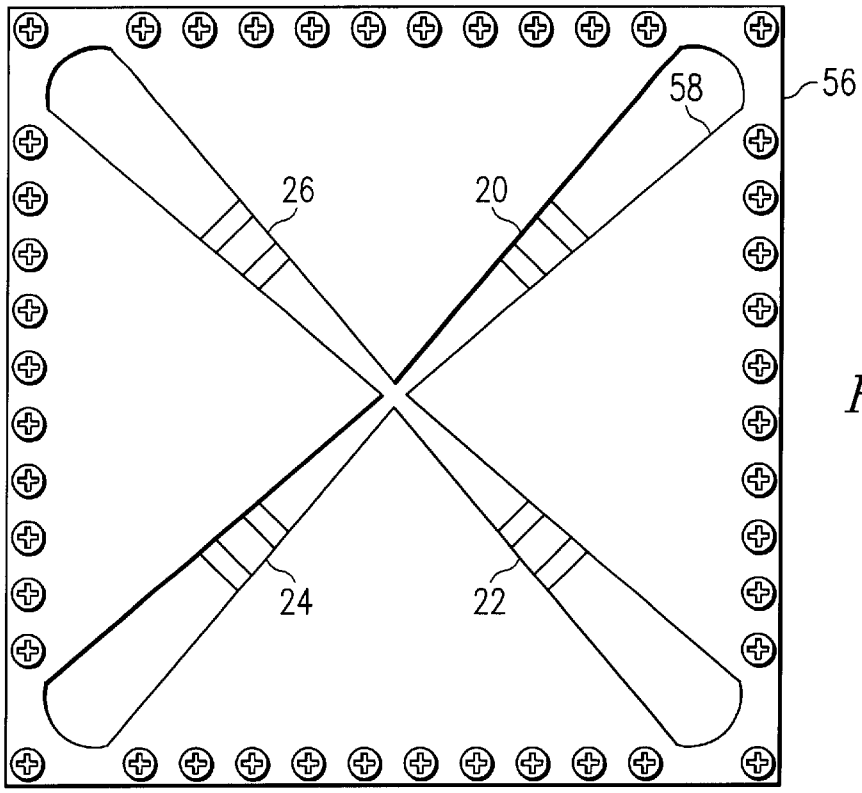
FIG. 4 is a top view of a single element broadband S-line cross slot GPS antenna implemented using a bow tie cross slot configuration with suspended S-line feeds and an air cavity as illustrated in FIG. 3.
Figure 5A:
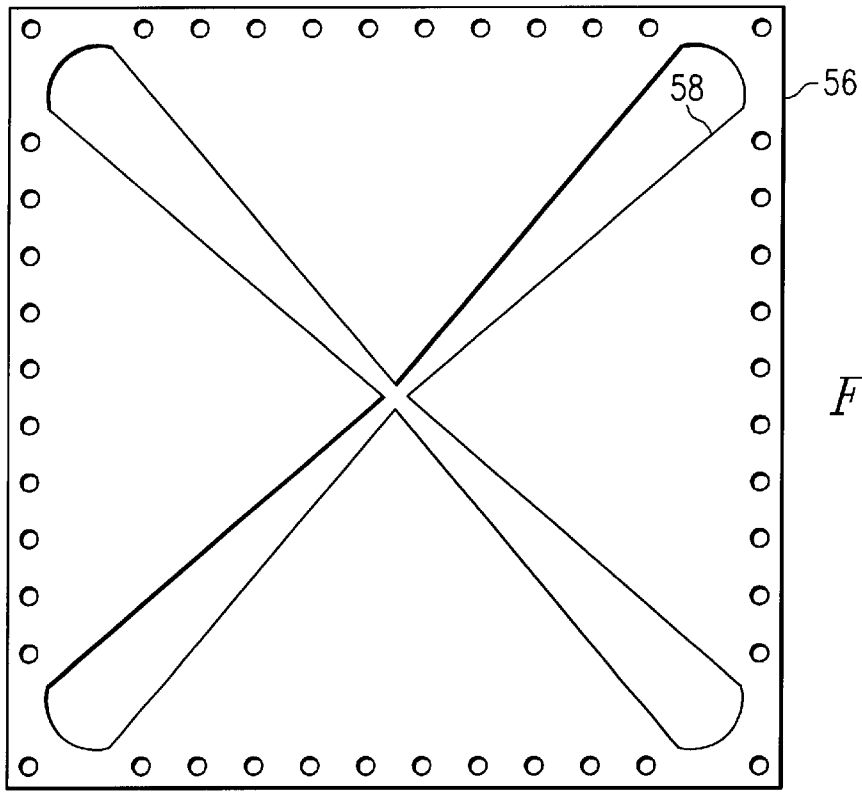
FIGS. 5*a*, 5*b*, 5*c*, 5*d* and 5*e* are top level illustrations of the single element cross slot antenna of FIG. 4 including the bow tie cross slot layer, a first spacer layer, a suspended S-line feed layer, a second spacer layer, and a ground layer, respectively.
Figure 5B:
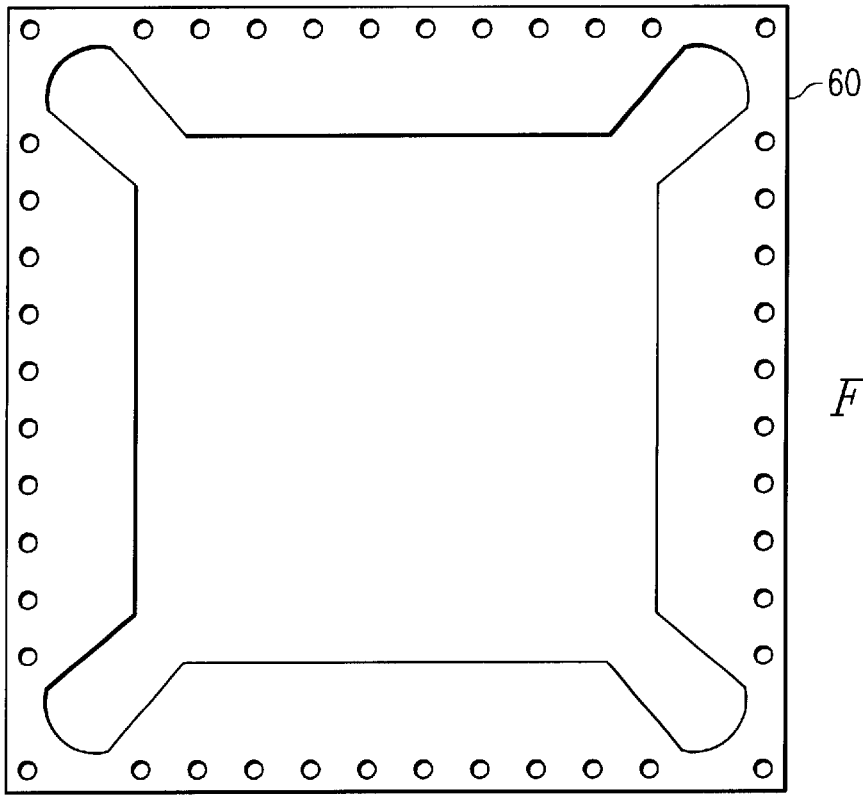
Figure 5C:
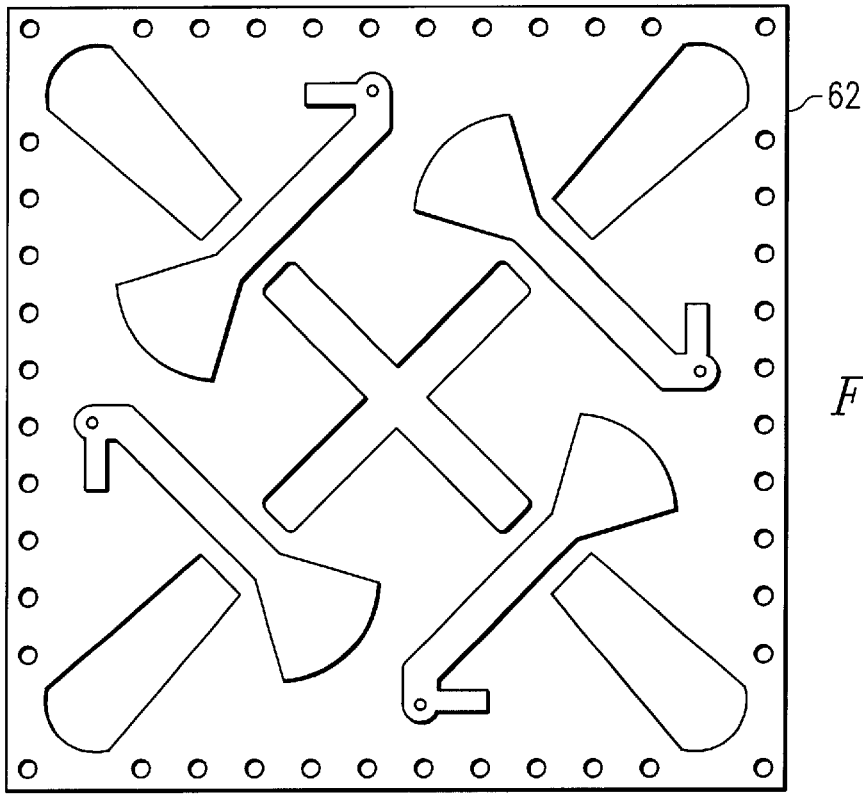
Figure 5D:
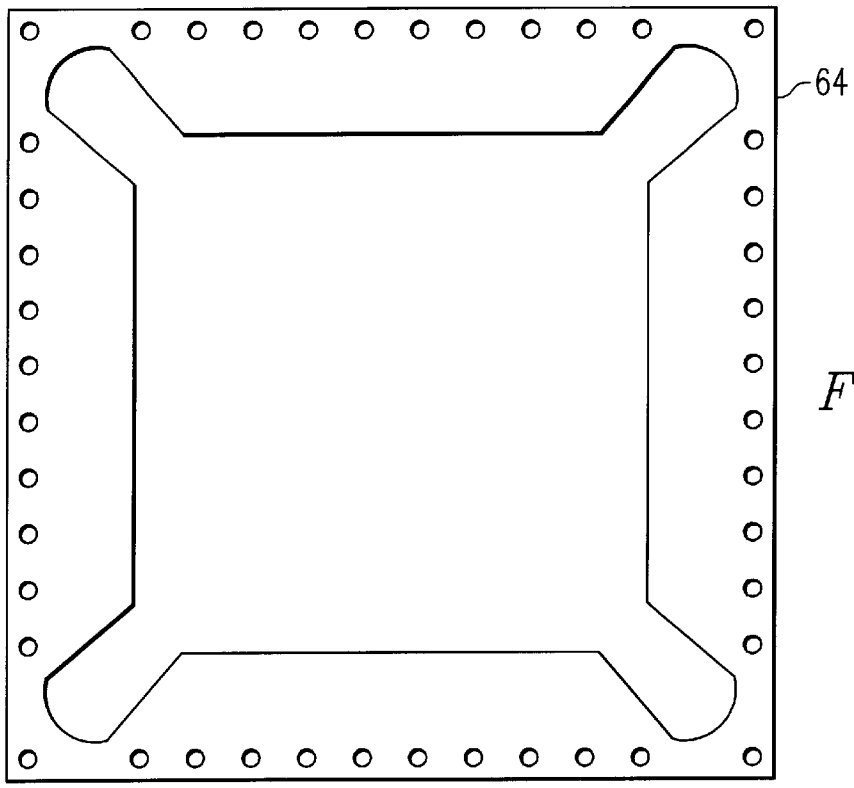
Figure 5E:
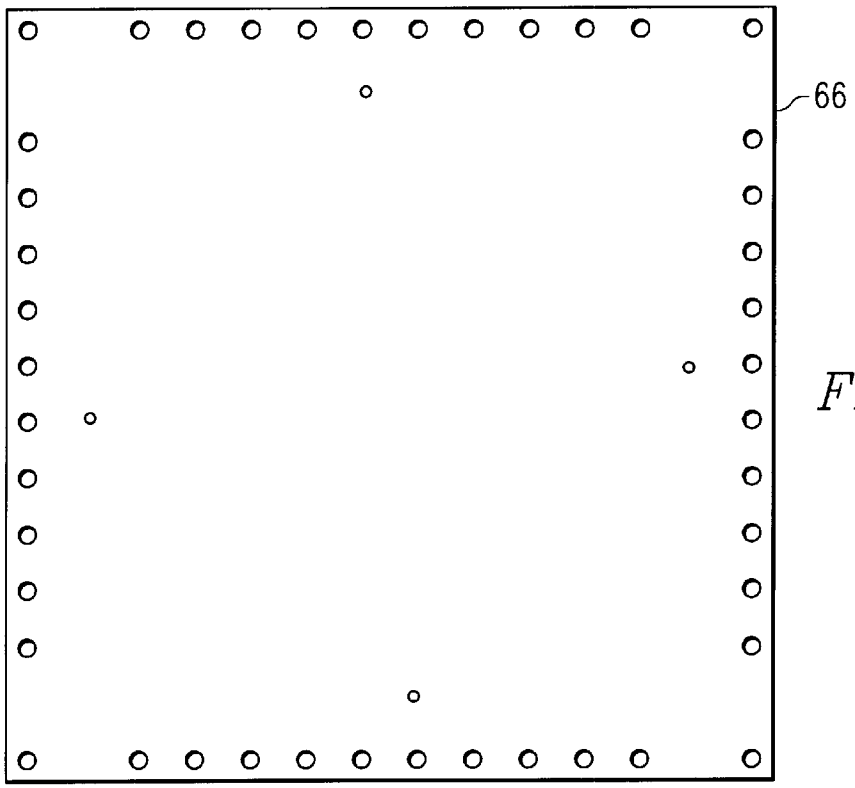

Referring to FIGS. 4 and 5A–5E, there is illustrated a single element broadband (L1–L2, 30% BW) S-line cross slot antenna. Radiating cross slot layer 56, as shown in FIGS. 4 and 5, includes a radiating element comprising bow tie slots 58 as alternatives to the narrow slot configuration of FIGS. 1 and 2. The bow tie slots 58 receive energy by means of transmission feeds 20, 22, 24 and 26. As more specifically shown in FIGS. 5A–5E, the single radiating element, broadband S-line cross slot antenna comprises a layer structure including the radiating cross slot layer 56, a first spacer layer 60, a suspended S-line feed layer 62 (see FIG. 3), a second spacer 64 and a ground plane layer 66. All the layers are constructed from FR4 material.

Figure 6:
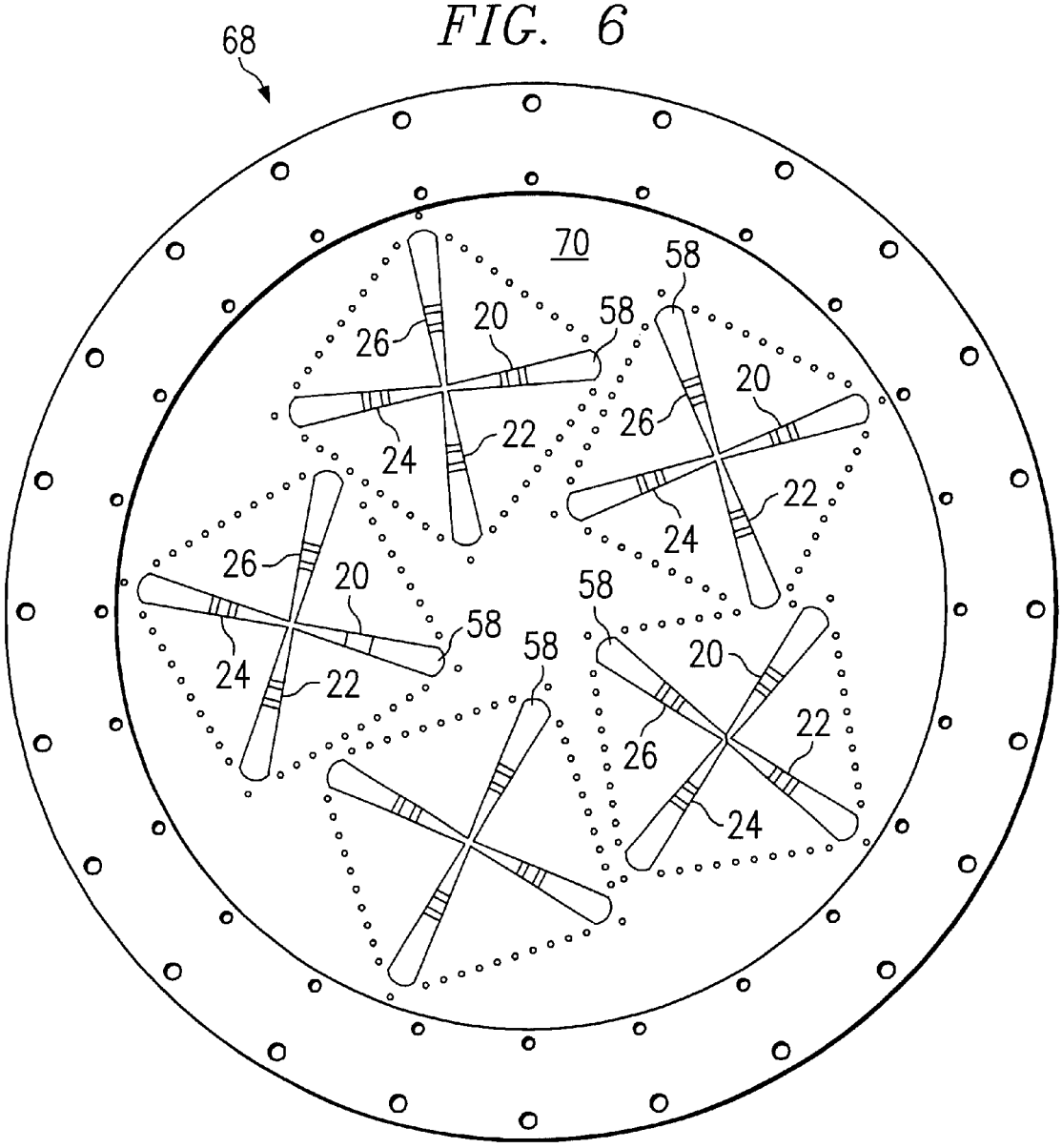
FIG. 6 is a top view of a five element, bow tie, S-line cross slot antenna for broadband applications with vertical feed inputs.
Figure 7:
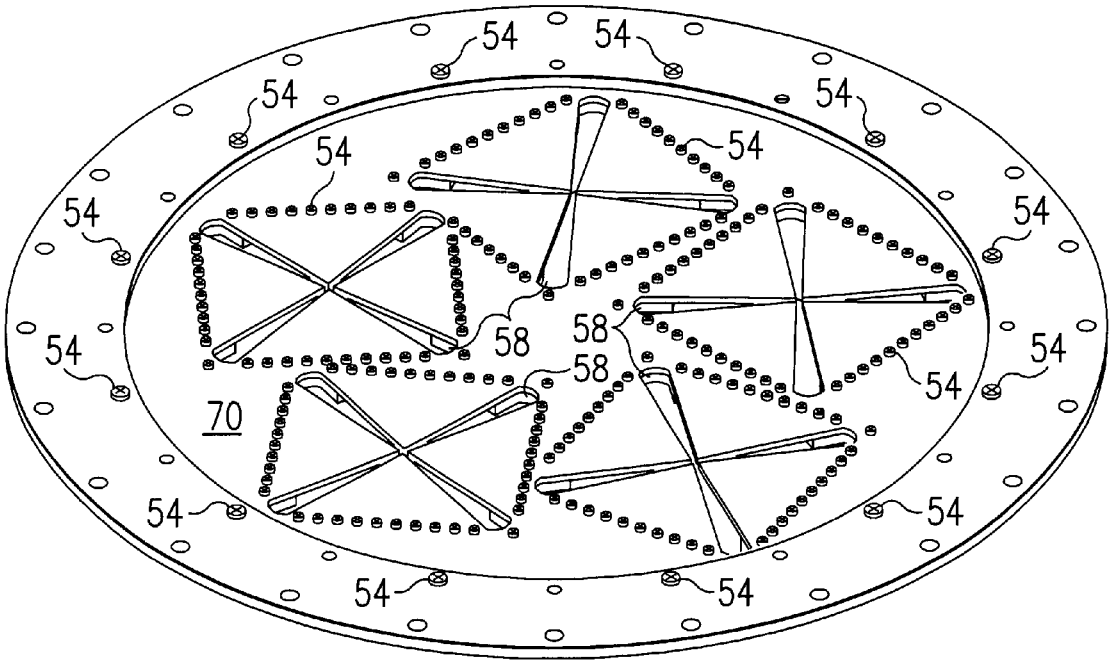
FIG. 7 is a top view of the upper surface of the five element bow tie cross slot layer for the antenna of FIG. 6.
Figure 8:
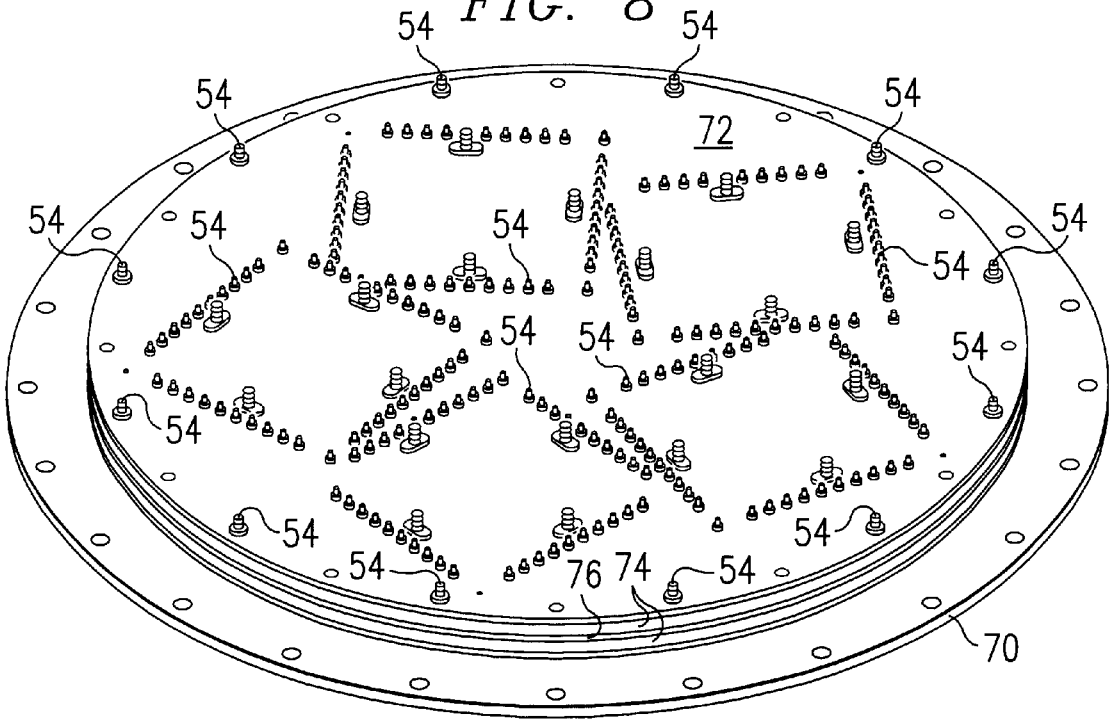
FIG. 8 is a bottom view of the five element S-line cross slot antenna of FIG. 6.
Figure 9A:
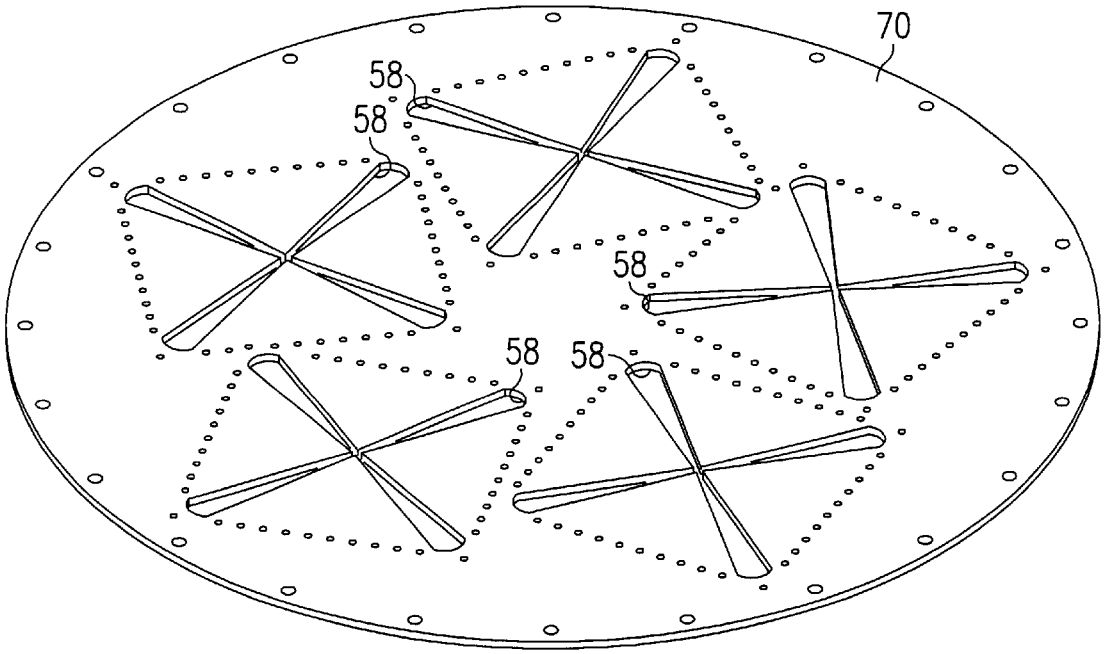
FIGS. 9*a*, 9*b*, 9*c* and 9*d* are illustrations of the layers of the five element cross slot antenna of FIG. 6 including a radiating bow tie cross slot layer, first and second spacer layers, and S-line feed layer and a ground layer, respectively.
Figure 9B:
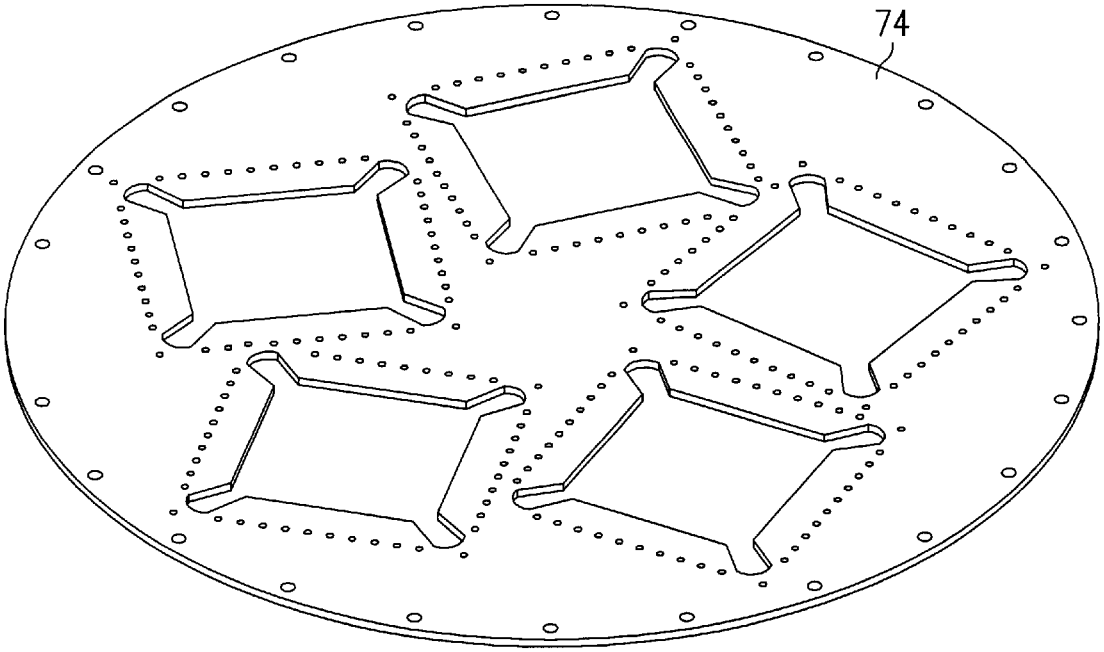
Figure 9C:
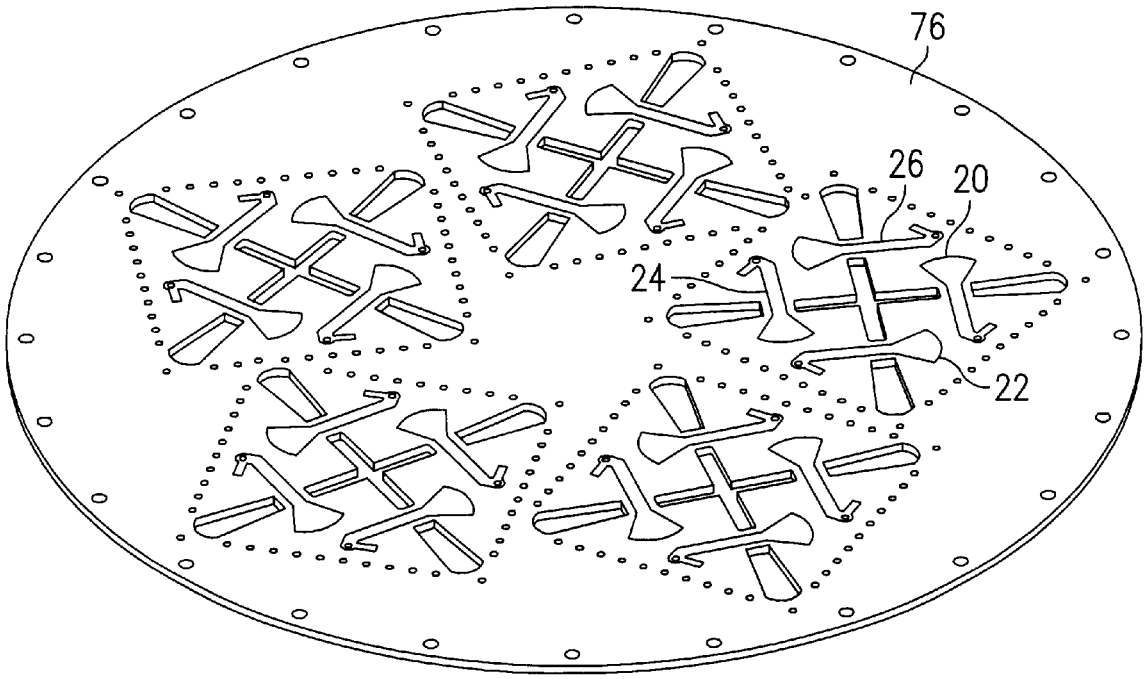
Figure 9D:
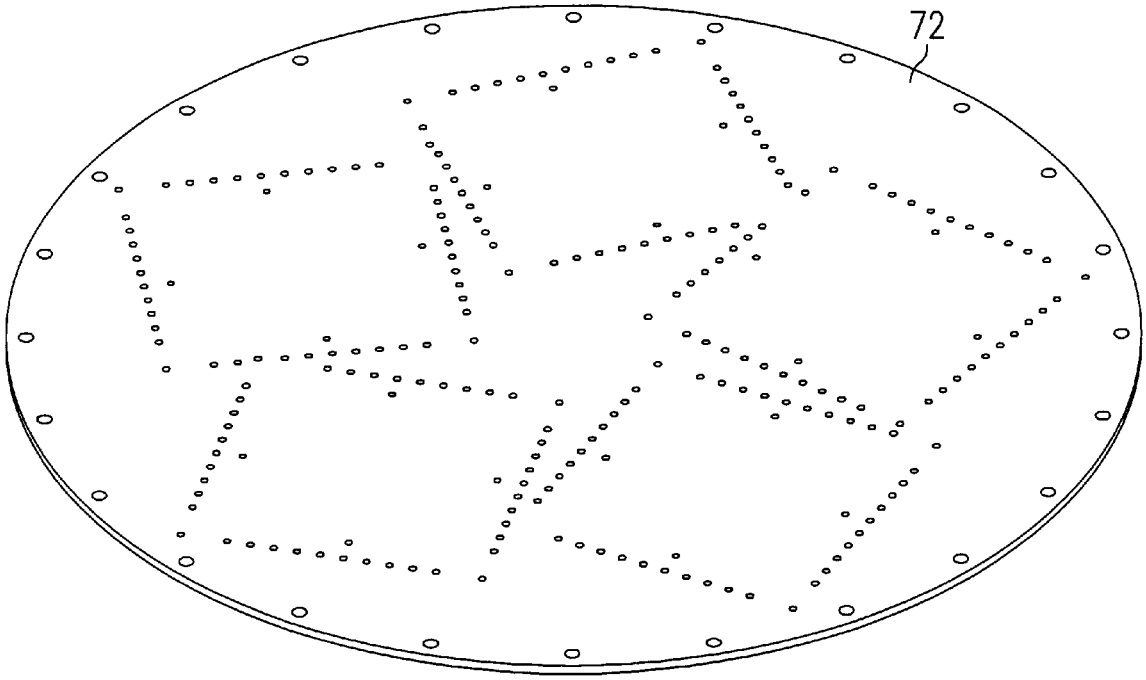
Figure 10A:
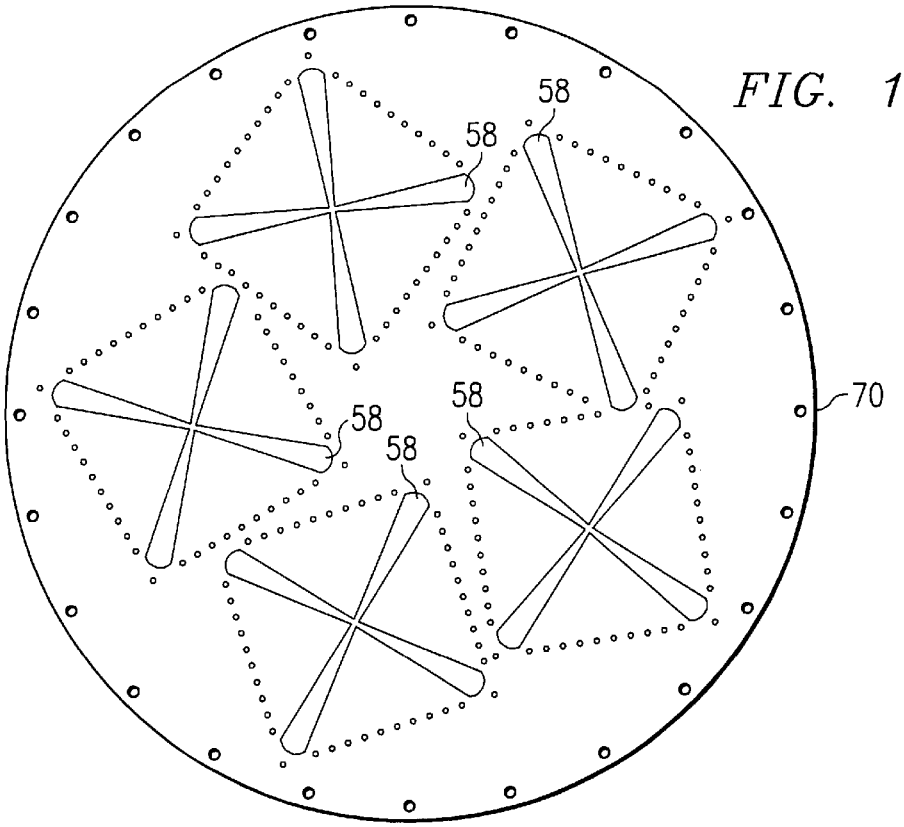
FIGS. 10*a*, 10*b*, 10*c*, 10*d* and 10*e* are CAD drawings of the layer structure for the five element S-line cross slot antenna of FIG. 6.
Figure 10B:
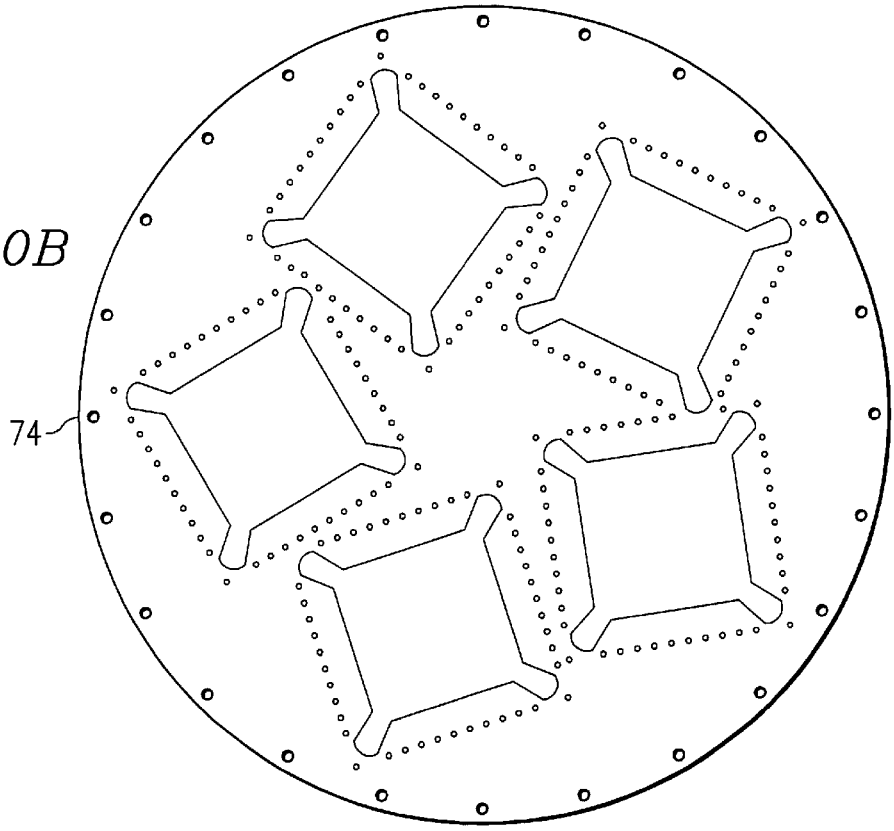
Figure 10C:
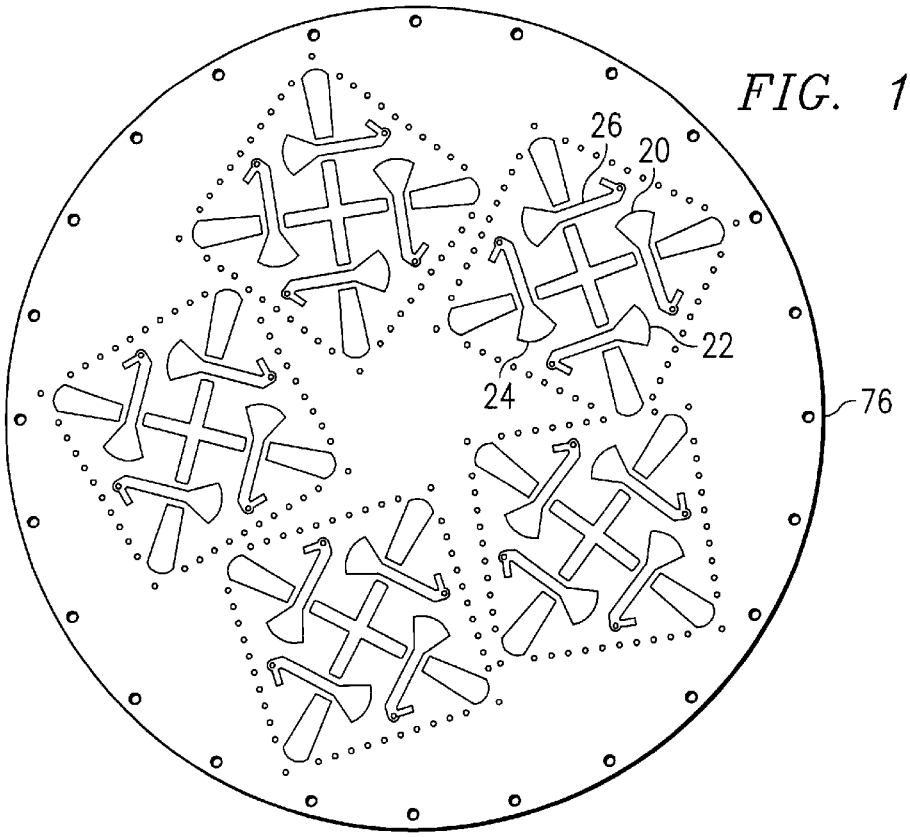
Figure 10D:
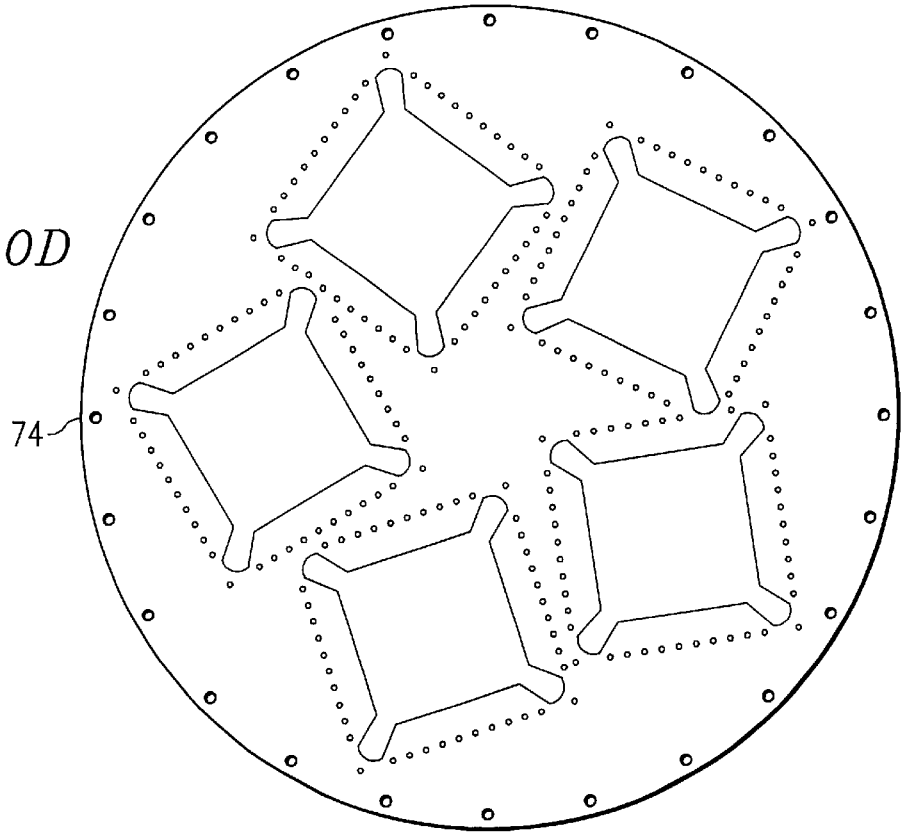
Figure 10E:
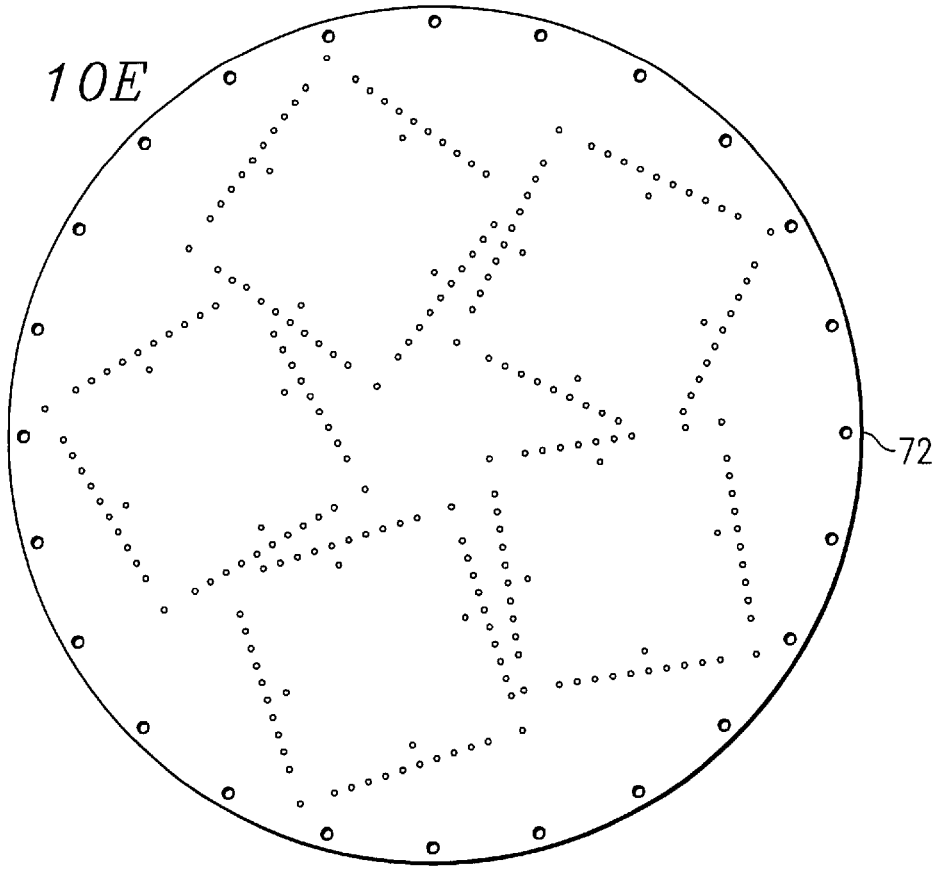

Referring to FIGS. 6, 7 and 8, there is illustrated a five radiating element S-line cross slot antenna for broadband (L1–L2, 30% BW), with vertical feed. The plurality of cross slots of each radiating element have a bow tie configuration 58 as illustrated in FIG. 4. FIGS. 6 and 7 show the top view of a five radiating element cross slot antenna and FIG. 8 is a bottom view of the five radiating element cross slot antenna with vertical feed inputs mounted to the ground plane layer 72 (see FIG. 3 layer 44).

Referring to FIGS. 9A–9D, there is shown the individual layers of the five radiating element S-line cross slot antenna of FIGS. 6, 7 and 8. The layer structures include a radiation slot layer 70, a ground plane layer 72, a suspended S-line feed layer 76 and spacer layers 74. As previously discussed, each radiating element is defined by plated through vias 54 that connect the ground plane layer 72 to the radiating layer 70.

Referring to FIGS. 10A–10E, there is illustrated a CAD drawing of the layer structure for a five radiating element S-line cross slot antenna including the radiation slot layer 70, the ground plane layer 72, the first and second spacer layers 74 and the suspended S-line feed layer 76.

Figure 11A:
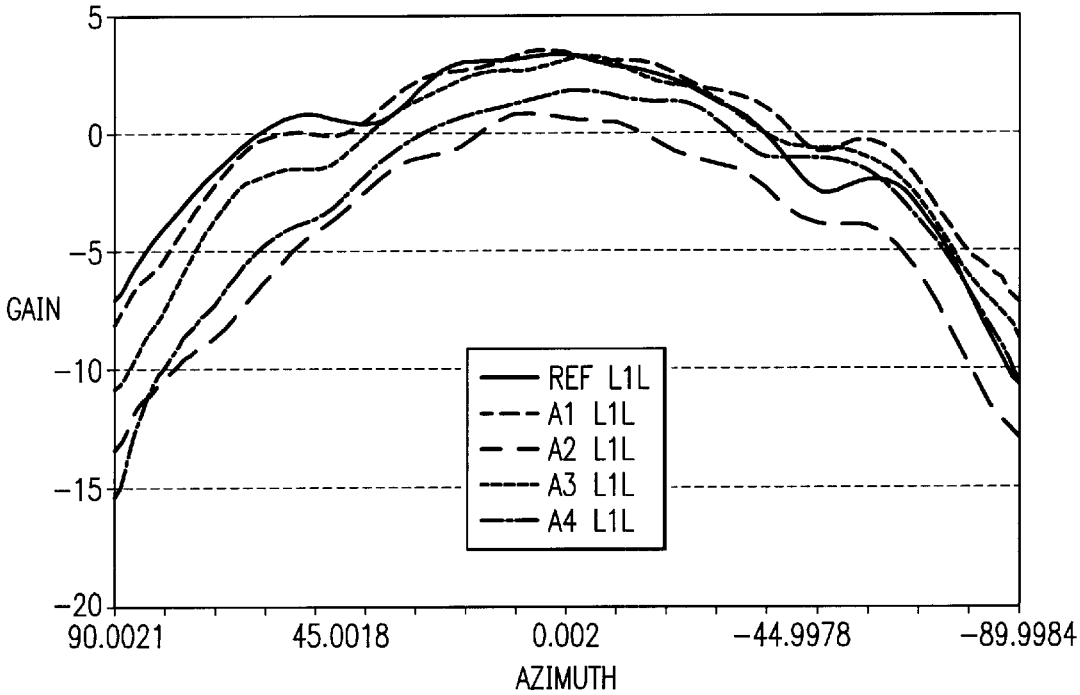
FIGS. 11*a*, 11*b* and 11*c* illustrate antenna radiation patterns of the five element S-line cross slot antenna of FIG. 6 for L1, L1M, and L1H roll.
Figure 11B:
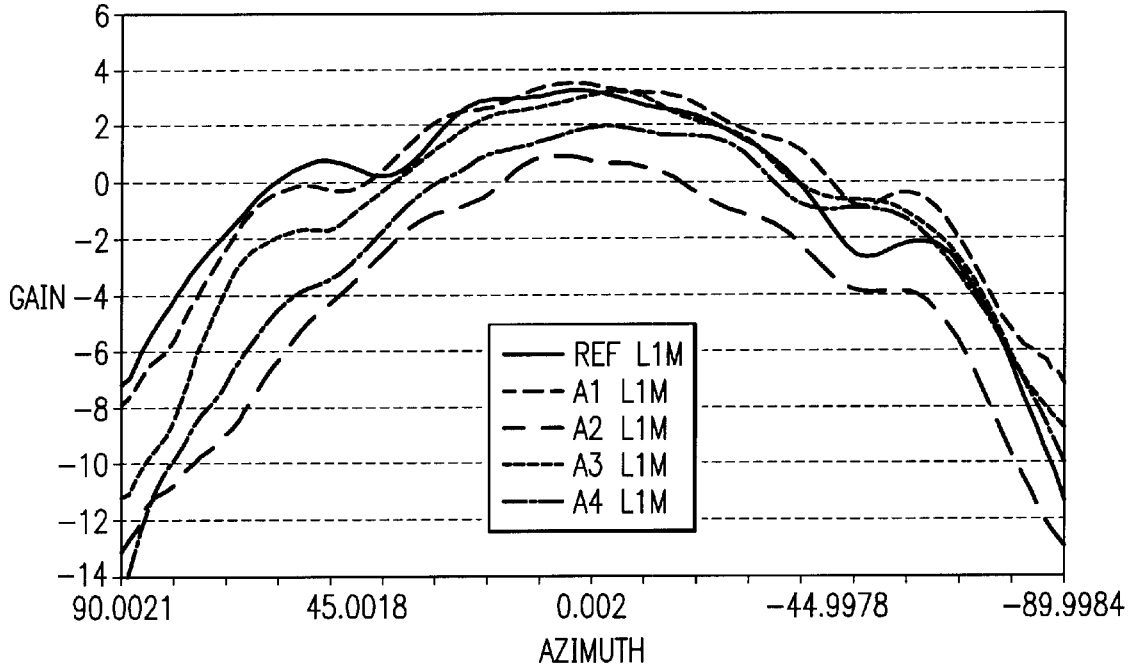
Figure 11C:
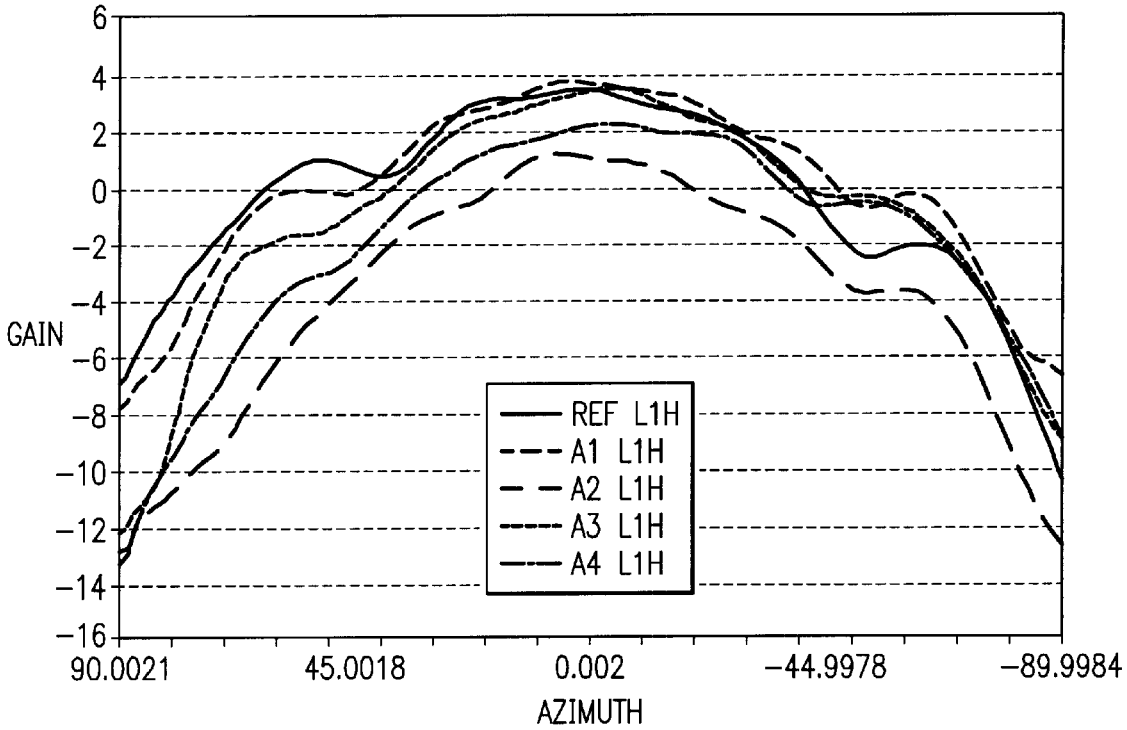

Referring to FIGS. 11A–11C, there is illustrated test results of an S-line radiating element cross slot antenna on a plot of gain versus azimuth. FIG. 11A illustrates test results for reference L1L, FIG. 11B illustrates test results for reference L1M, and FIG. 11C represents test results for reference L1H.

Figure 12A:
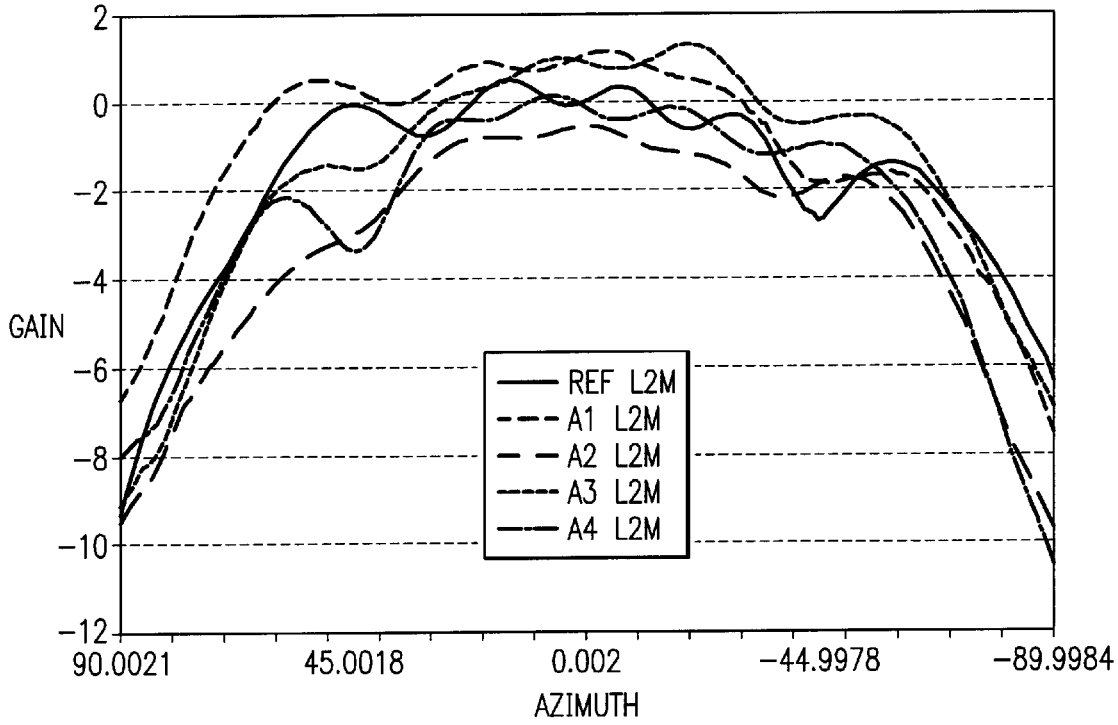
FIGS. 12*a* and 12*b* illustrate antenna radiation patterns of the five element S-line cross slot antenna of FIG. 6 for L2M and L2H roll.
Figure 12B:
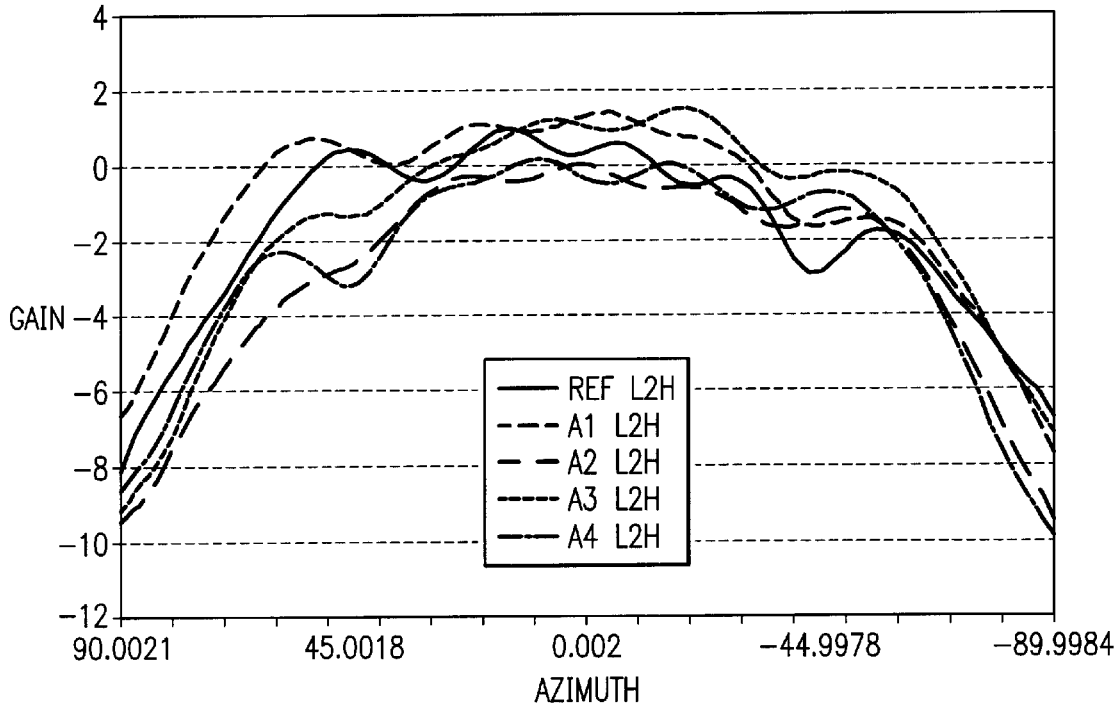

FIGS. 12A and 12B show test results for an S-line radiating element cross slot antenna for reference L2M and L2H, respectively. The test results are a plot of gain versus azimuth.

Figure 13A:
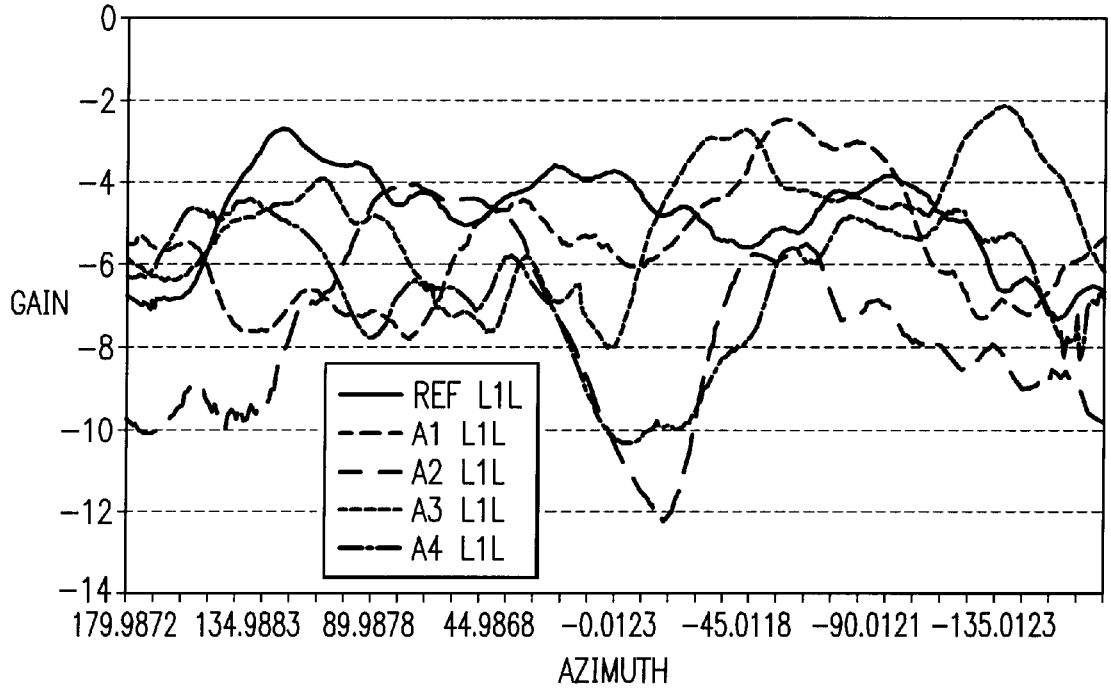
FIGS. 13*a*, 13*b* and 13*c* illustrate antenna radiation patterns of the five element S-line cross slot antenna of FIG. 6 for 10° at reference L1L, L1M, and L1H, respectively.
Figure 13B:
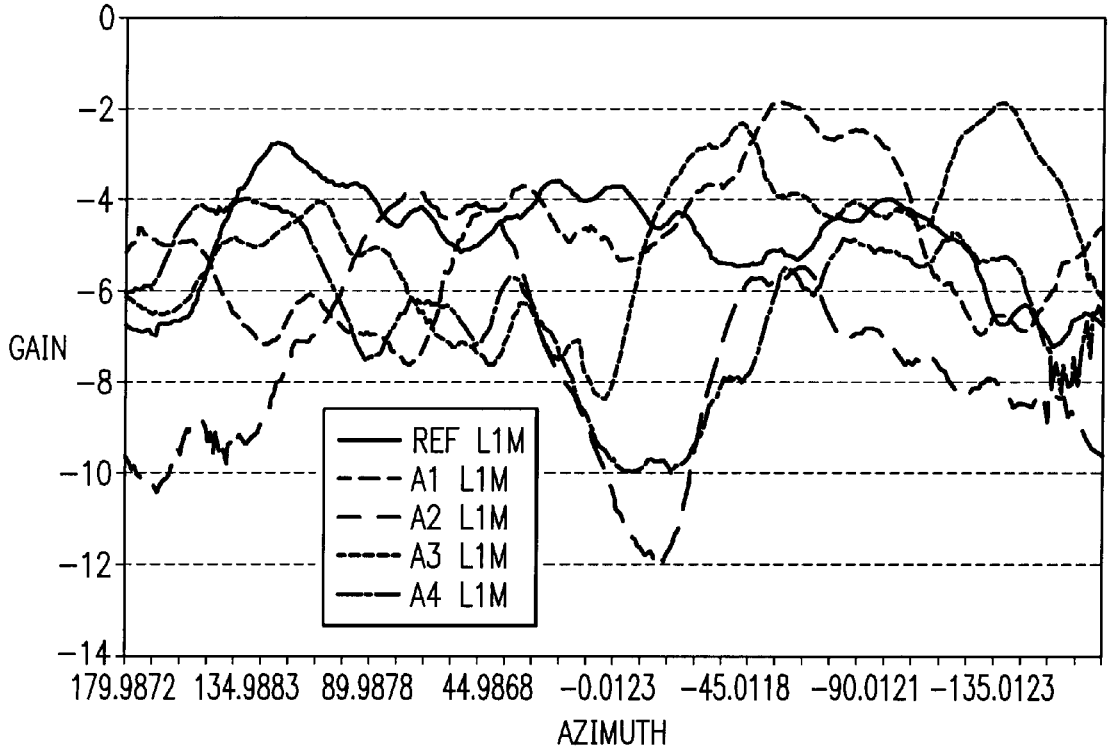
Figure 13C:
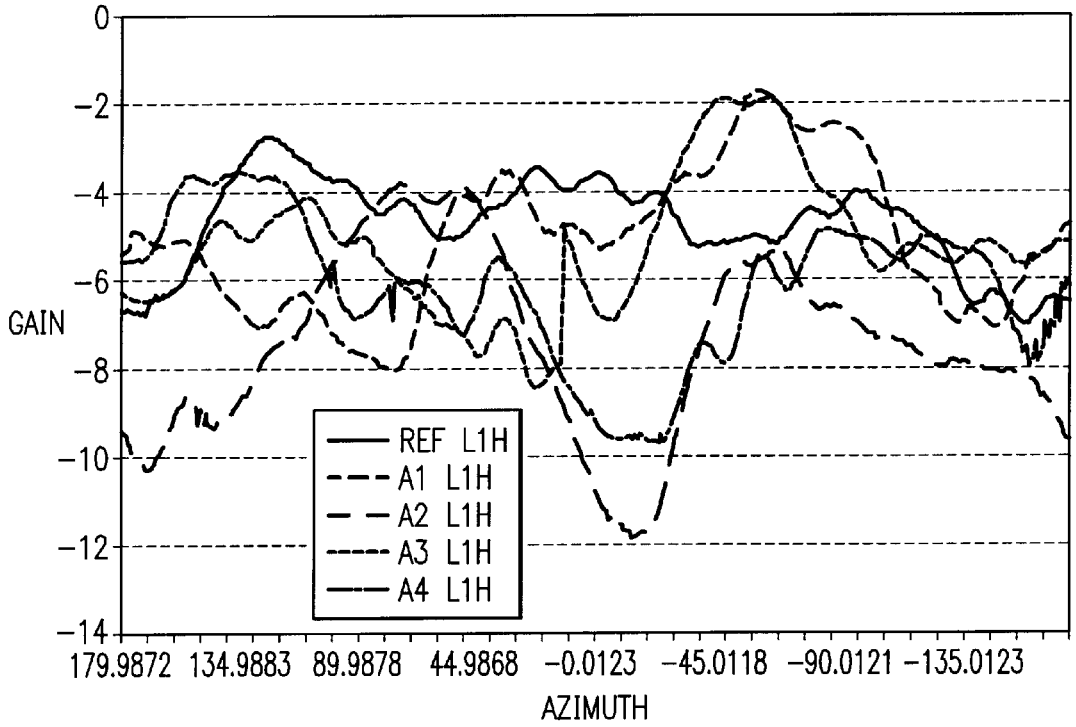

Referring to FIGS. 13A, 13B and 13C, there is illustrated plots of gain versus azimuth for an S-line radiating element slot antenna. The test results are for reference L1L, L1M and L1H, respectively.

Figure 14A:
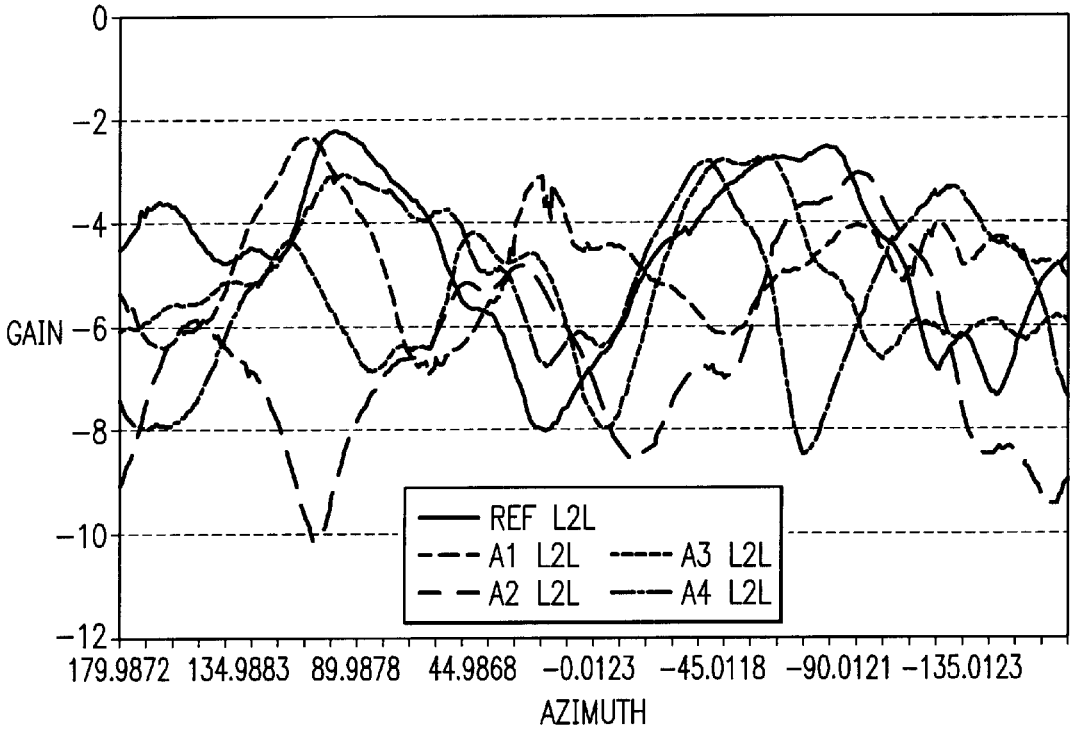
FIGS. 14*a*, 14*b* and 14*c* illustrate antenna radiation patterns for the five element S-line cross slot antenna of FIG. 6 for 10° at reference L2L, L2M and L2H, respectively.
Figure 14B:
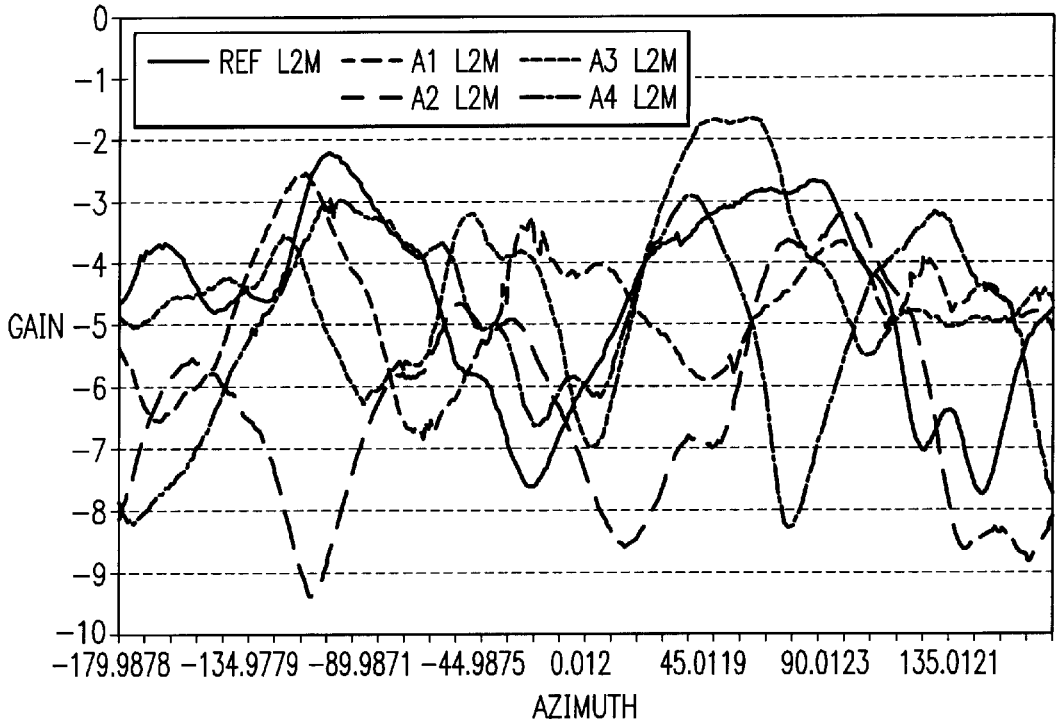
Figure 14C:
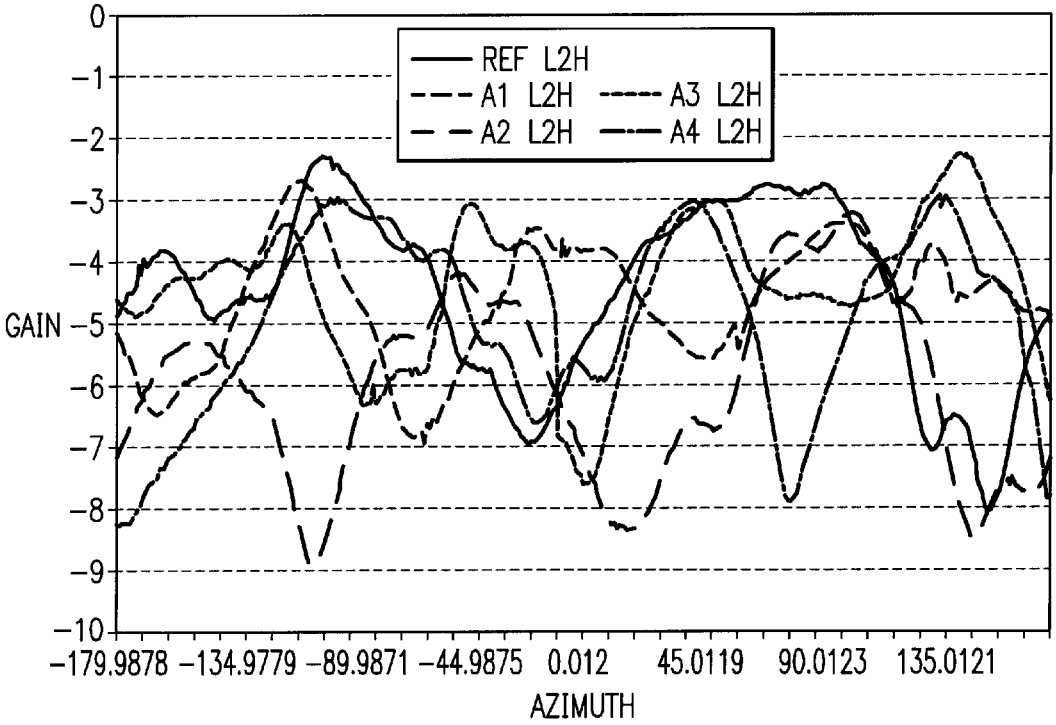

FIGS. 14A, 14B and 14C are plots of gain versus azimuth for an S-line radiating element cross slot antenna for references L2L, L2M and L2H, respectively.

Figure 15A:
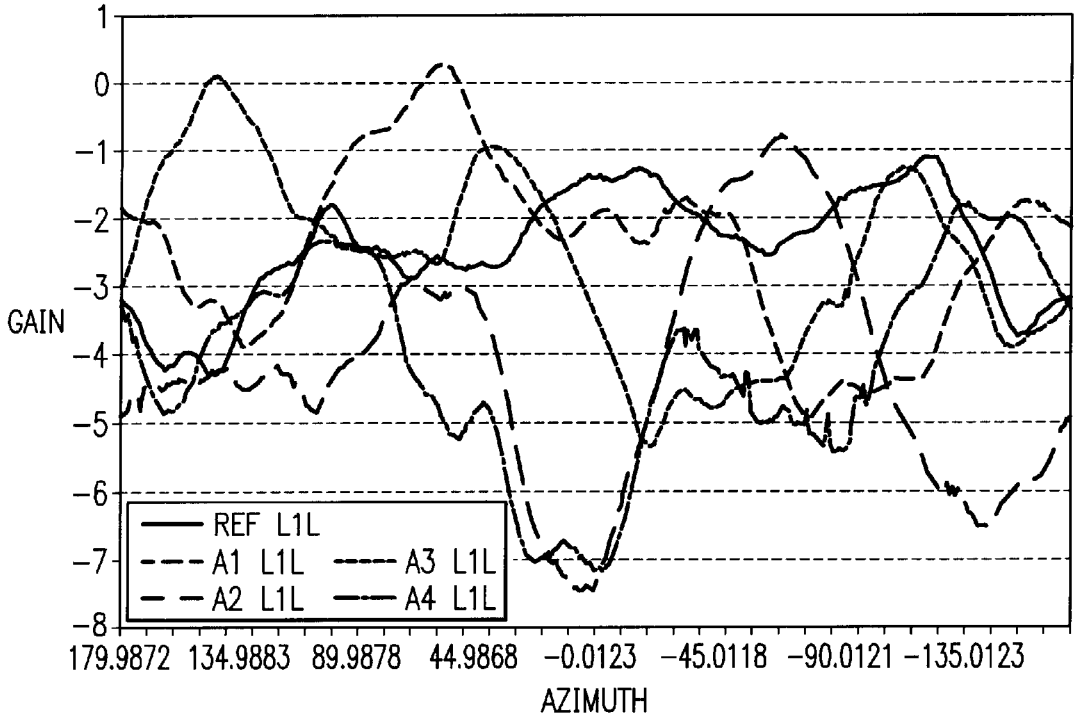
FIGS. 15*a*, 15*b* and 15*c* illustrate antenna radiation patterns for the five element S-line cross slot antenna of FIG. 6 for 20° at reference L1L, L1M and L1H, respectively.
Figure 15B:
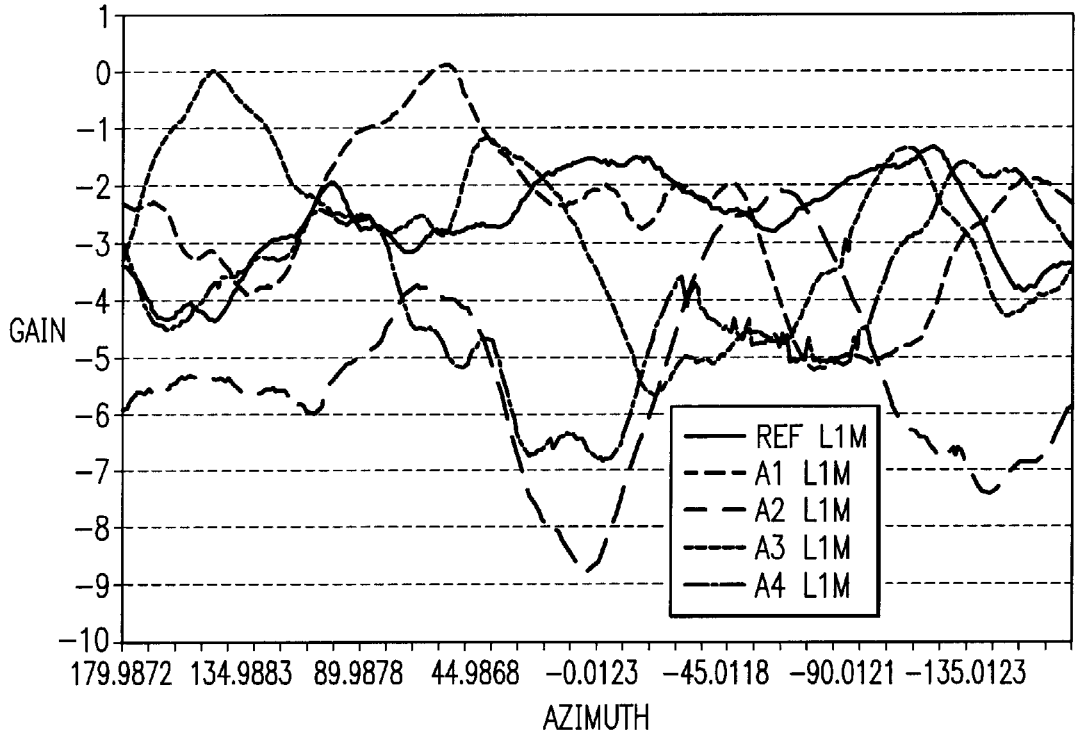
Figure 15C:
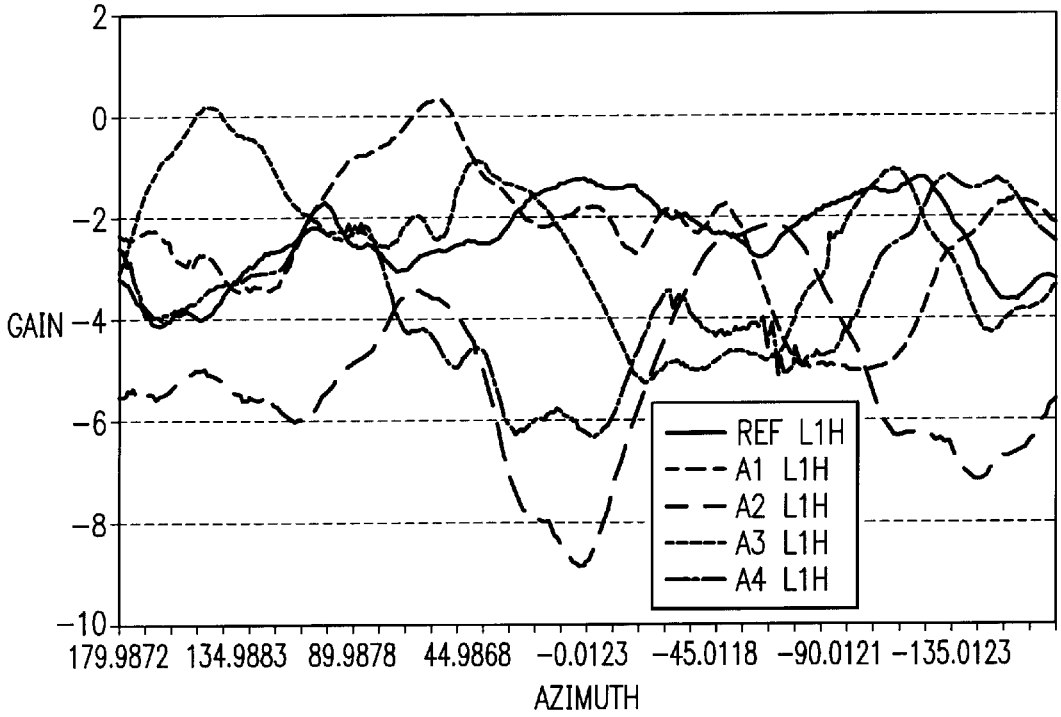
Figure 16A:
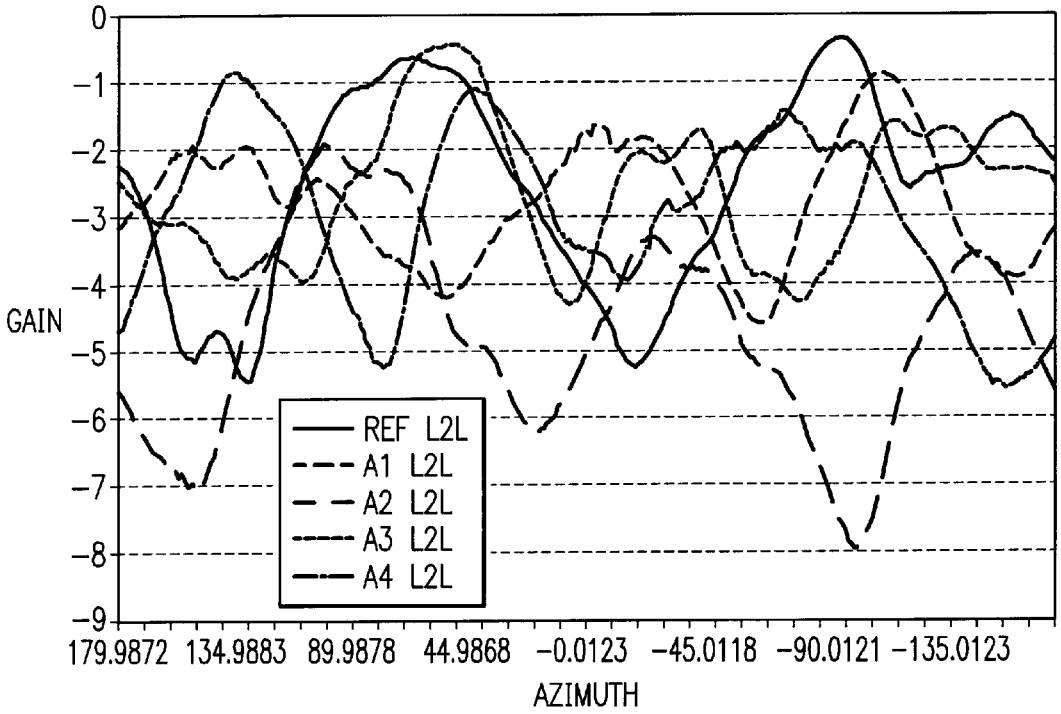
FIGS. 16*a*, 16*b* and 16*c* illustrate antenna radiation patterns for the five element S-line cross slot antenna of FIG. 6 for 20° at reference L2L, L2M and L2H, respectively.
Figure 16B:
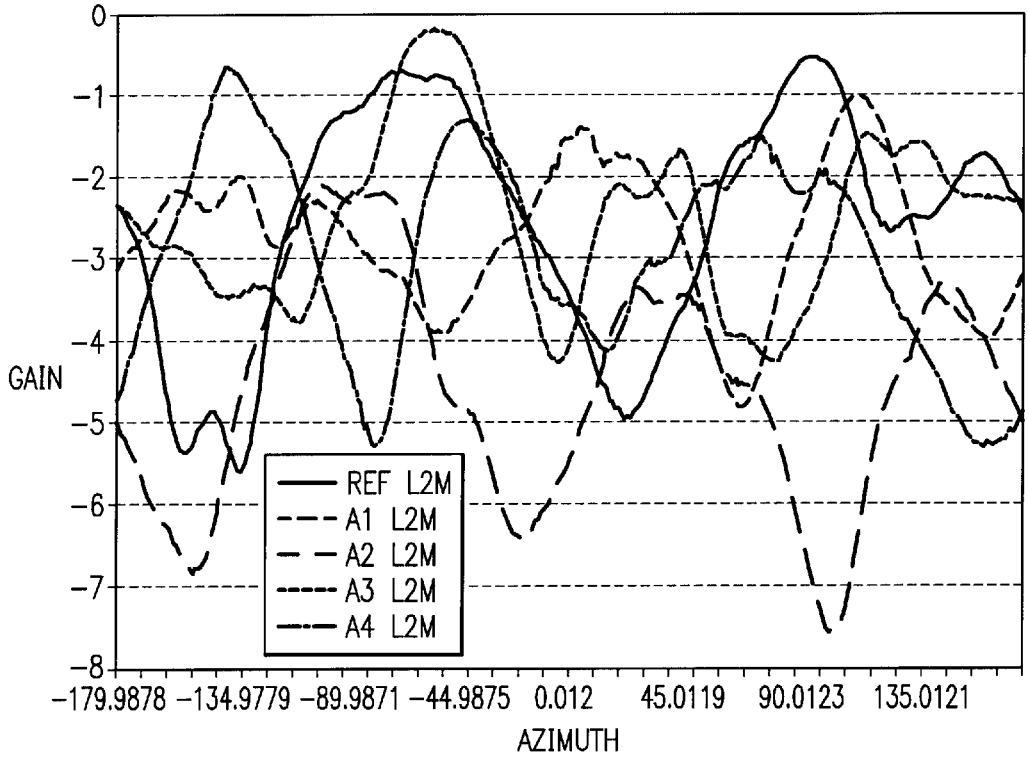
Figure 16C:
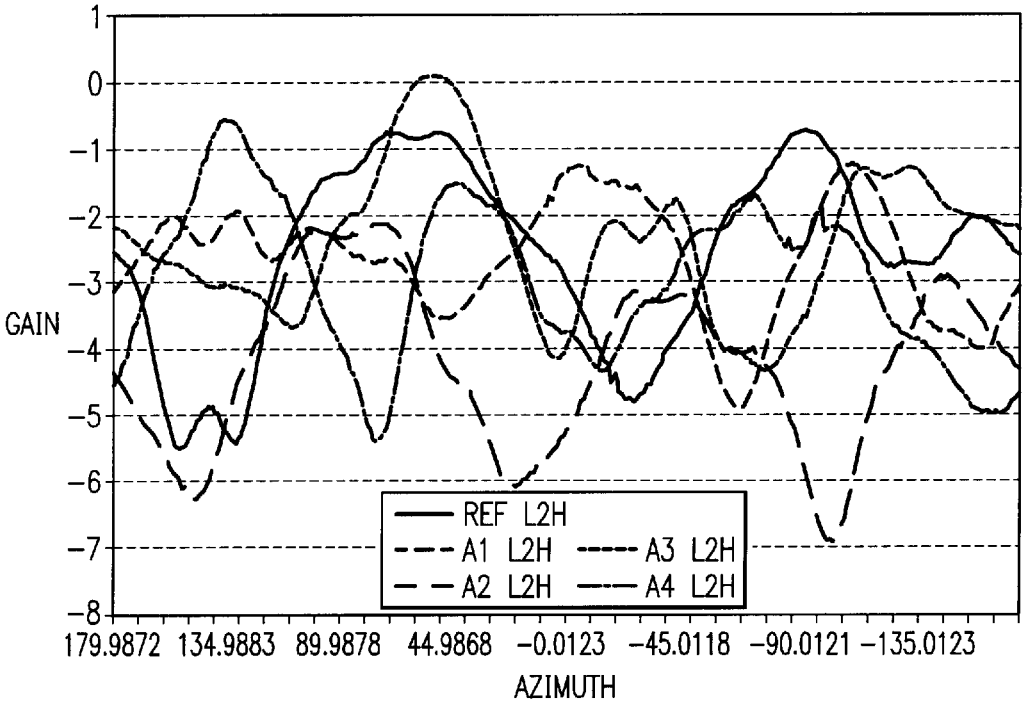

FIGS. 15A, 15B and 15C illustrate test results as a plot of gain versus azimuth for an S-line radiating element cross slot antenna. FIG. 15A illustrates test results for reference L1L, FIG. 15B represents test results for reference L1M and FIG. 15C represents test results for reference L1H. FIGS. 16A, 16B and 16C illustrate test results for L2L, L2M and L2H, respectively.

Figure 17A:
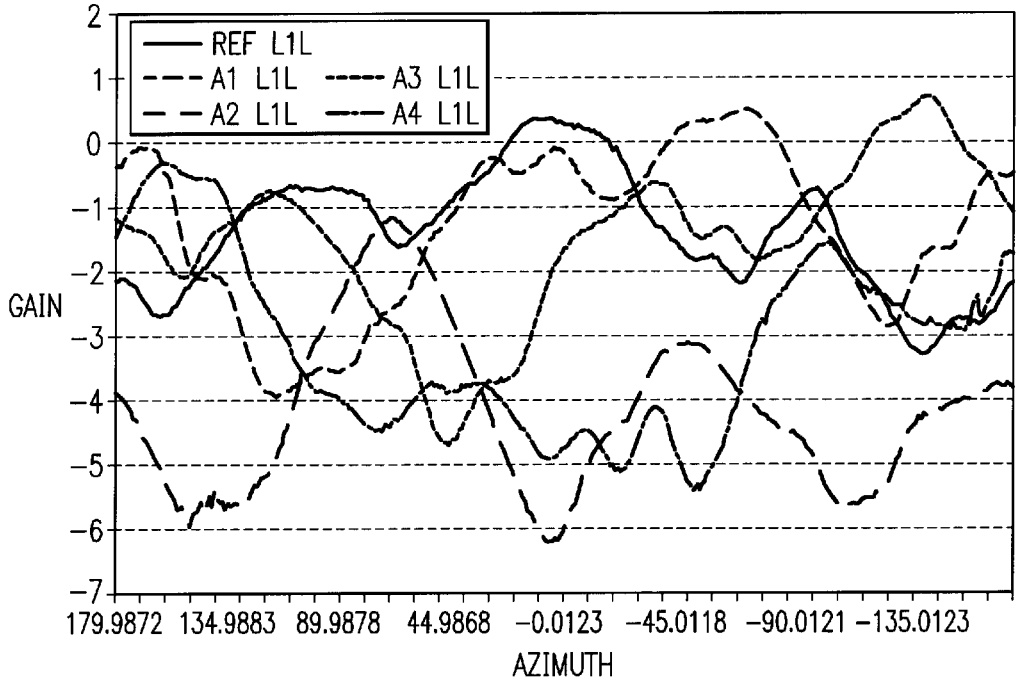
Figure 17B:
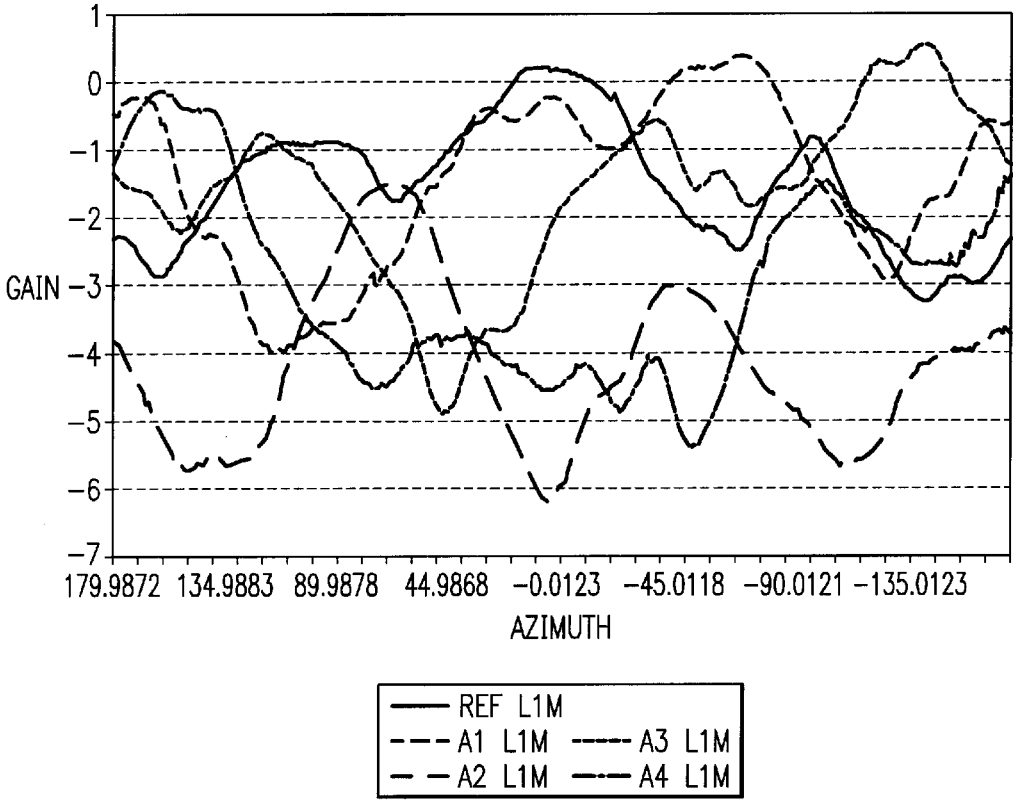

FIGS. 17A, 17B, and 17C illustrate test results as a plot of gain versus azimuth for an S-line radiating element cross slot antenna at references L1L, L1M and L1H, respectively.

Figure 18B:
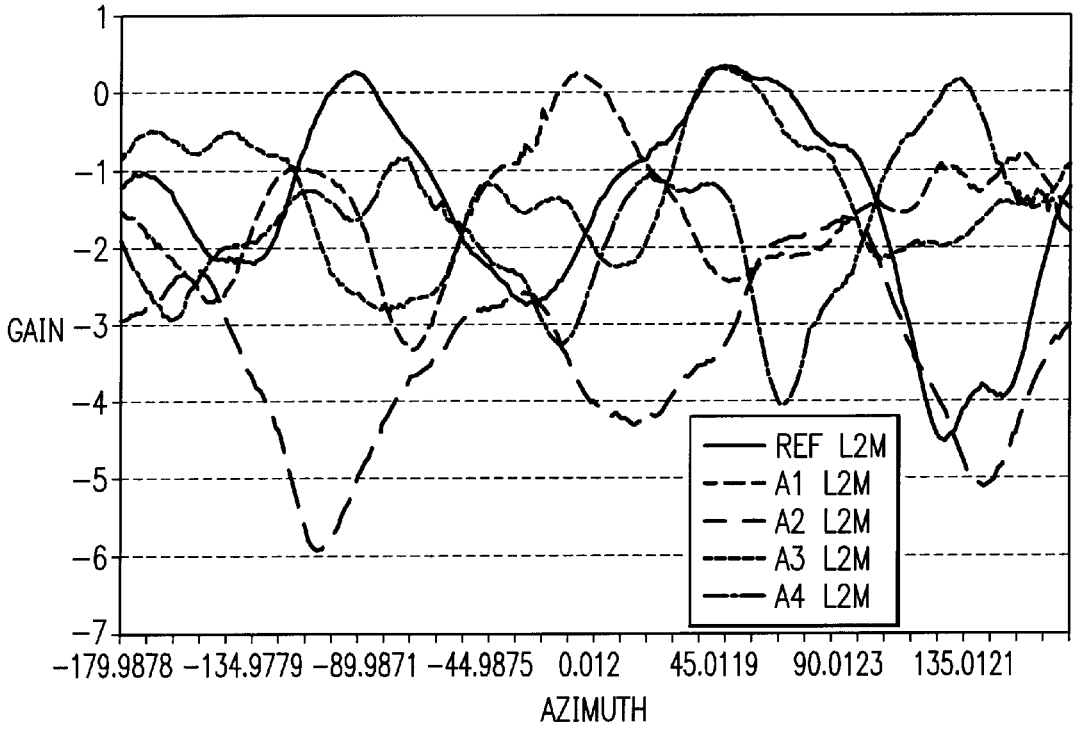
Figure 18C:
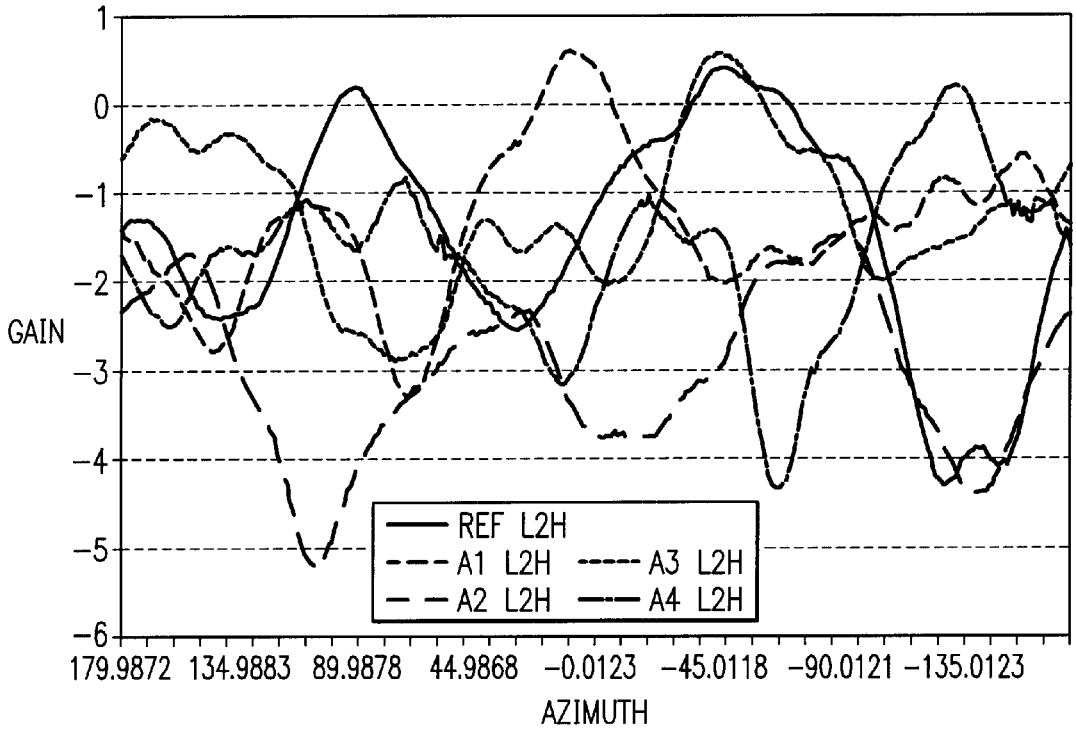
Figure 19:
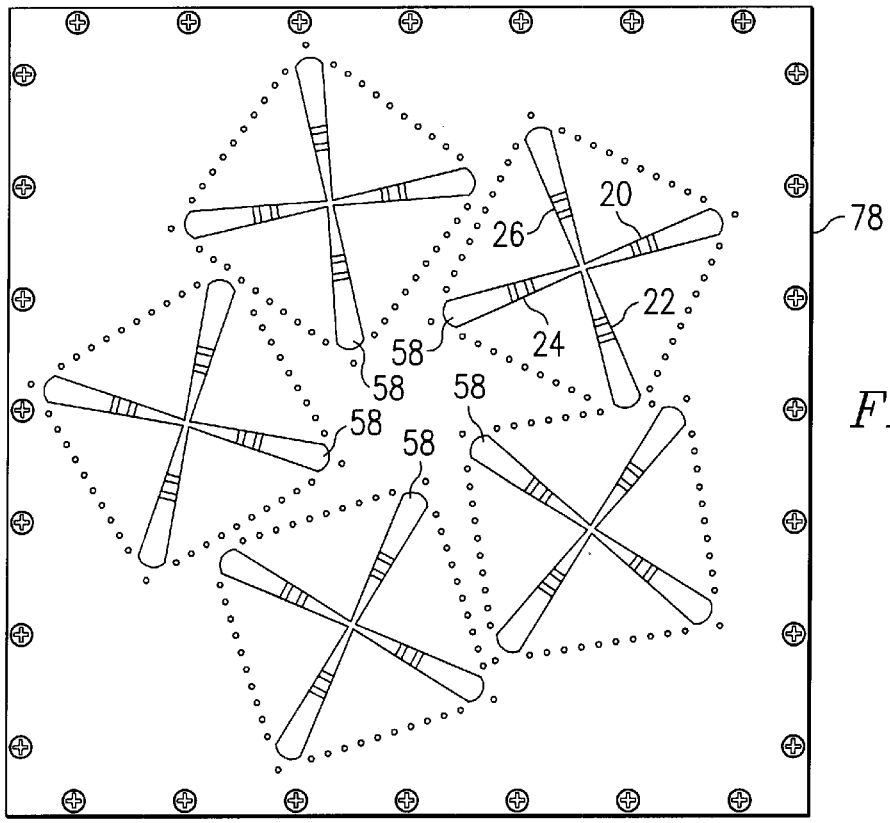
FIG. 19 is a pictorial illustration of a five element S-line cross slot antenna having a diamond shape configuration for improved radar cross section performance.
Figure 20A:
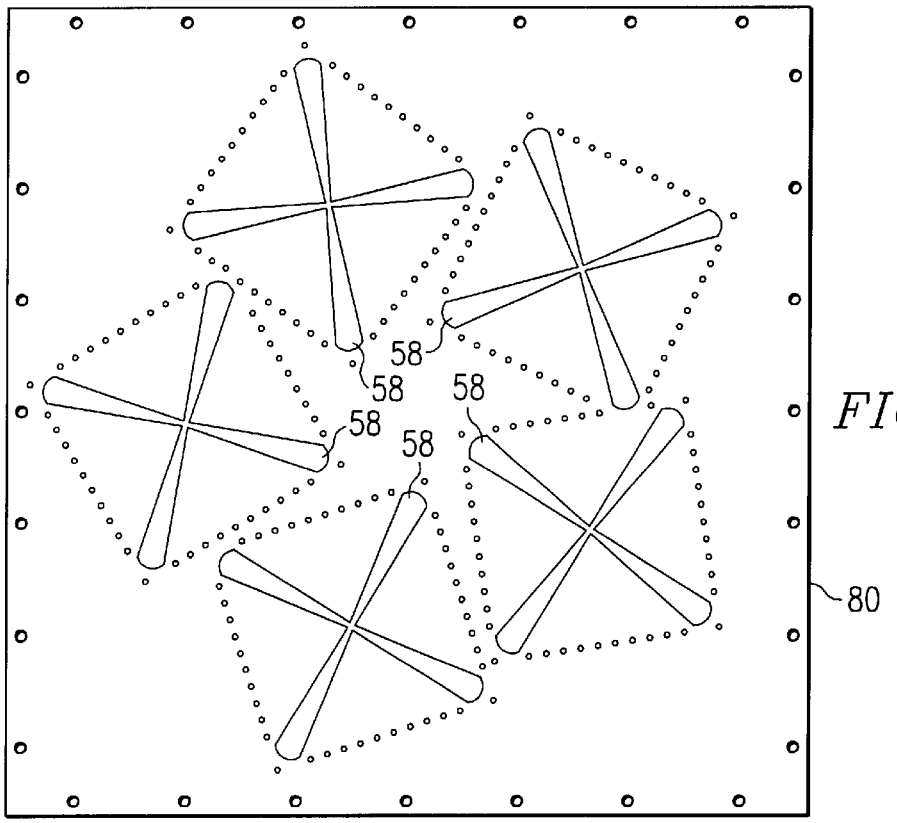
FIGS. 20*a*, 20*b*, 20*c*, 20*d* and 20*e* are top view illustrations of the radiating cross slot layer, a first spacer layer, an S-line feed layer, a second spacer layer, and a ground plane layer, respectively, for the antenna of FIG. 19.
Figure 20B:
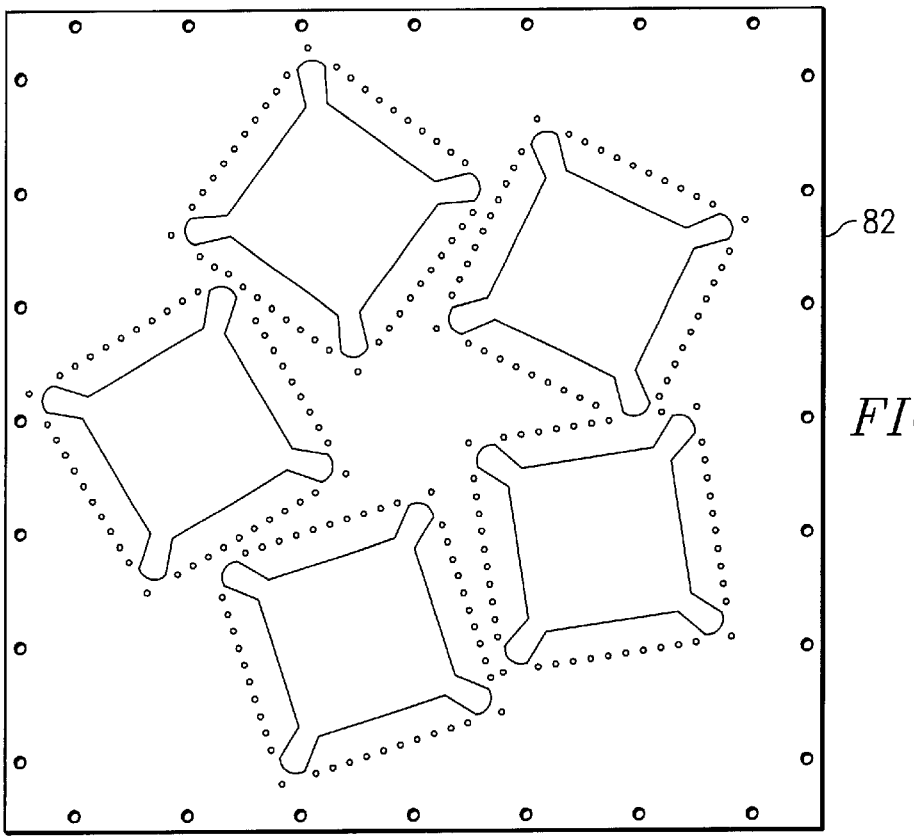
Figure 20C:
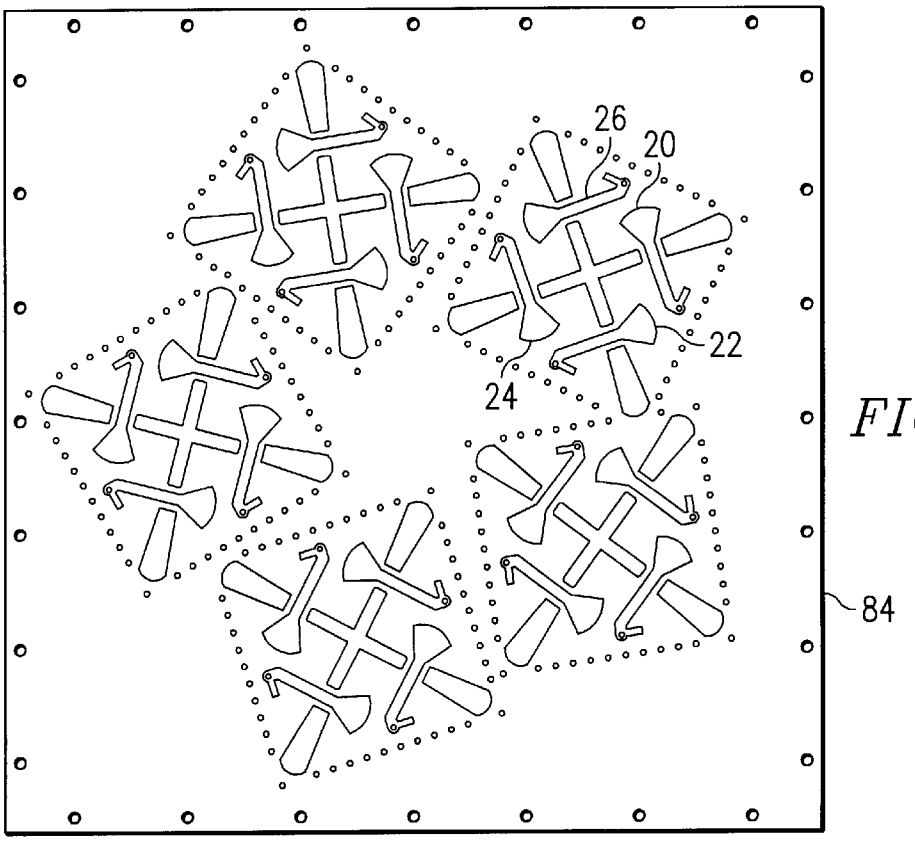
Figure 20D:
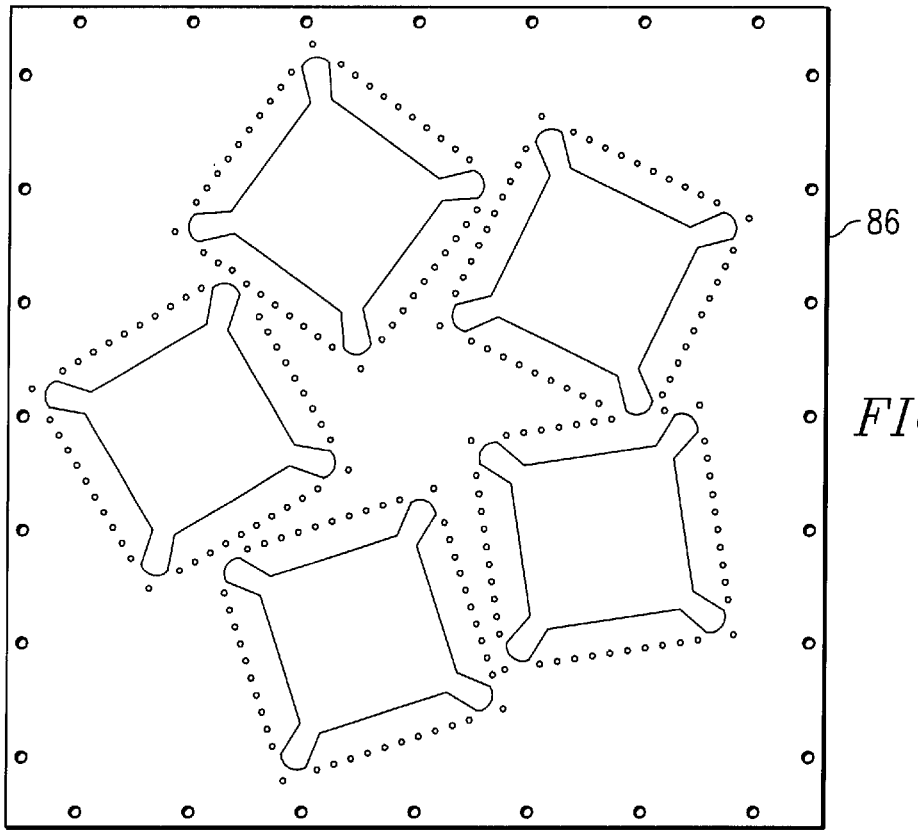
Figure 20E:
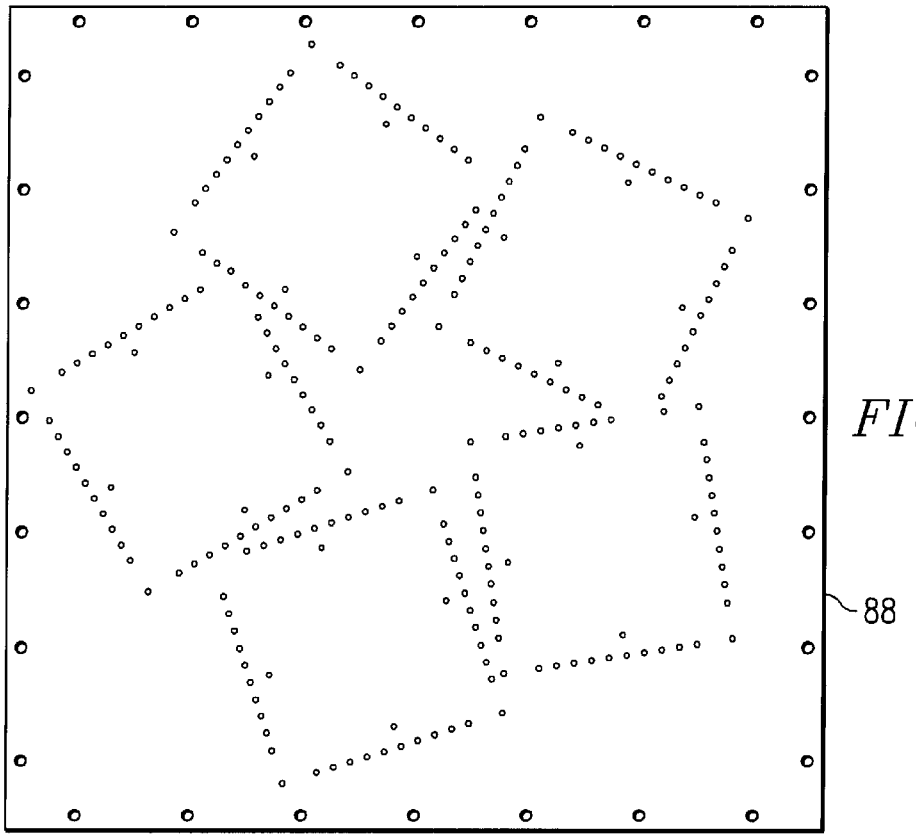

FIGS. 18A, 18B and 18C are test results for the same antenna for reference L2L, L2M and L2H, respectively.

Referring to FIGS. 19 and 20A–20E, there is illustrated an alternate embodiment of a five element S-line radiating element cross slot antenna for broadband (L1–L2, 30% BW). The five element antenna 78 of FIG. 19 has a diamond shape configuration for improved radar cross section performance. The antenna 78 comprises a layer structure including a five radiating element cross slot layer 80 having bow tie cross slots 58, a first spacer layer 82, an S-line feed line layer 84, a second spacer layer 86 and a ground plane layer 88. The layers are made of FR4 material with the layers 80 and 84 copper clad.

Figure 21:
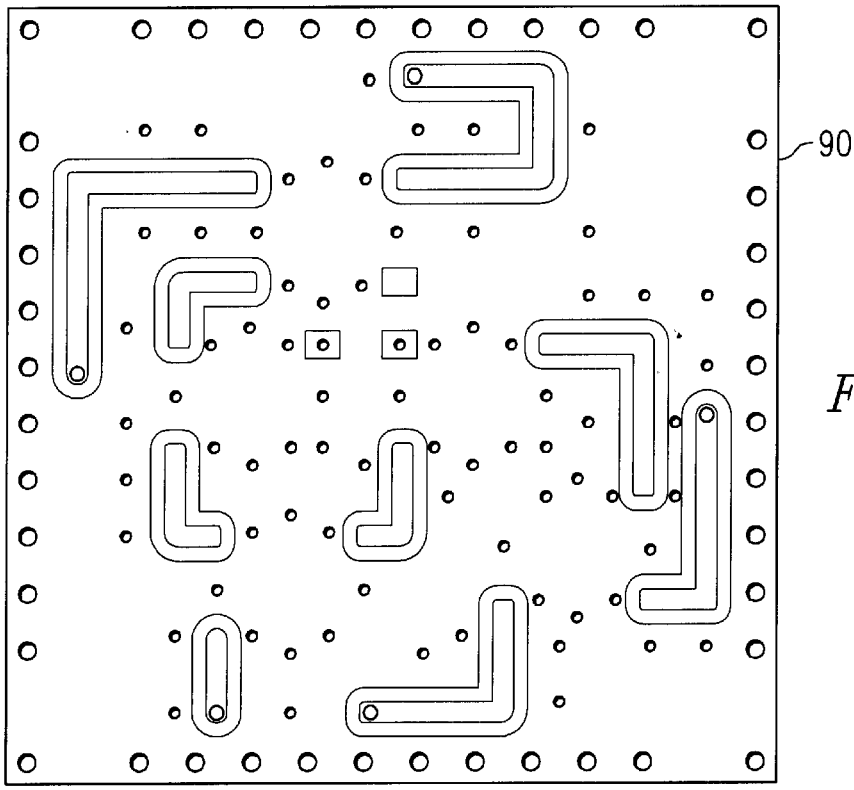
FIG. 21 is a top view of a phase shift layer as an integral part of the a vertical feed cross slot antenna of the present invention.
Figure 22:
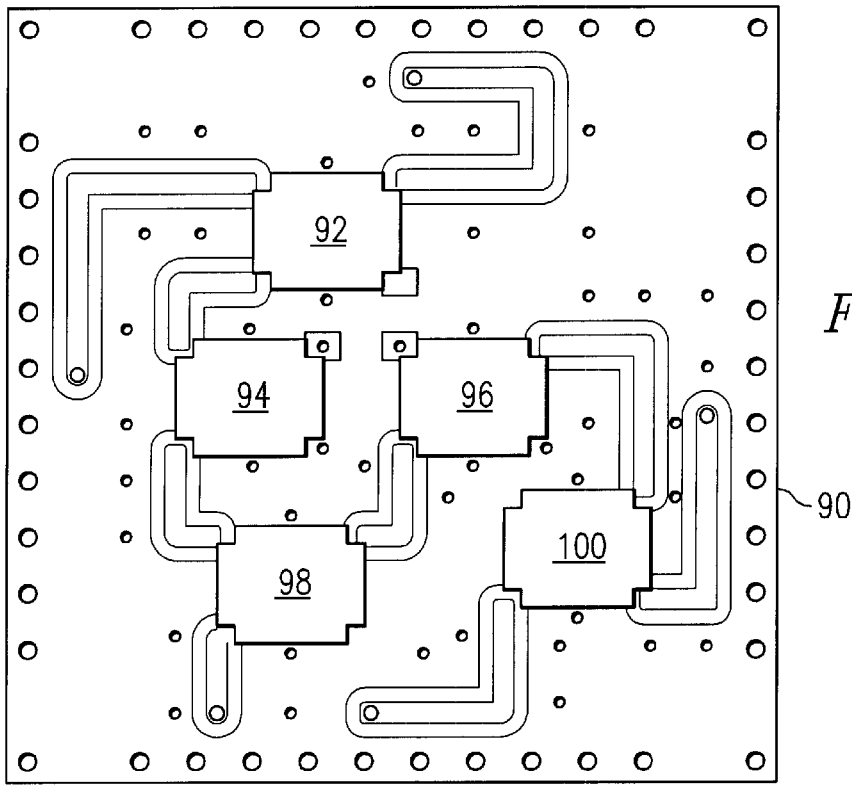
FIG. 22 is the phase shift layer integrated with quad hybrids.

Referring to FIGS. 21 and 22, there is illustrated a phase shift layer 90 with quad hybrids 92, 94, 96, 98 and 100 mounted to the phase shift layer 90. The phase shift layer 90 is assembled as an integral layer of the S-line cross slot antenna where vertical feed is by a plated via. The S-line phase shift layer 90 provides the quadrature inputs to the feeds 20, 22, 24 and 26 of the antenna. As illustrated in FIG. 22, this structure utilizes five 90° hybrids. The hybrids are installed in an S-line feed layer where all entrance transmission lines and routing are S-line thereby displaying low cost characteristics. The phase shifter of FIG. 21 and 22 provides outputs at 0°, 90°, 180°, and 270° with insertion loss of 1 dB nominal.

Although a preferred embodiment of the invention has been illustrated in the accompanying drawings and described in the foregoing detailed description, it will be understood that the invention is not limited to the embodiments disclosed, but is capable of numerous rearrangements and modifications of parts and elements without departing from the spirit of the invention.

What is claimed is:

1. A cross slot broad band cavity backed antenna, comprising:

a radiating element comprising a plurality of radiating slots configured in a radiating cross slot layer;

a first cavity configured in a first spacer layer, the first spacer layer positioned adjacent one side of the radiating layer;

suspended feed transmission lines equal in number to the plurality of radiating slots supported on a transmission feed layer, the transmission feed layer positioned adjacent to the first spacer layer;

a second cavity configured in a second spacer layer, the second spacer layer positioned adjacent to the transmission feed layer; and a ground plane comprising a copper clad surface on a ground plane layer, the ground plane layer positioned adjacent the second spacer layer.

2. The cross slot broad brand antenna as in claim 1, wherein the transmission feed layer comprises a lossy material having a loss tangent of no more than 0.04.

3. The cross slot broad band antenna as in claim 1, wherein the radiating cross slot layer includes a copper clad surface opposite a radiating surface.

4. The cross slot broad band antenna as in claim 1 wherein the plurality of radiating slots comprise a bow tie configuration.

5. The cross slot broadband antenna as in claim 1, wherein the suspended transmission line comprises a dual conductor, the conductors supported on opposite sides of the transmission feed layer.

6. The cross slot broadband antenna as in claim 1, further comprising mode suppression connectors interconnecting the radiating cross slot layer, the first and second spacer layers, the transmission feed layer and the ground plane layer.

7. The cross slot broadband antenna as in claim 1, wherein the first cavity and the second cavity comprise a propagation structure for the suspended feed transmission line.

8. A cross slot broad band cavity backed antenna, comprising:

a plurality of radiating elements each comprising a plurality of radiating slots configured in a radiating cross slot layer;

a first plurality of cavities equal in number to the radiating elements and configured on a first spacer layer, the first spacer layer position adjacent one side of the radiating layer;

suspended feed transmission lines equal in number to the plurality of radiating slots for each of the radiating elements supported on a transmission feed layer, the transmission feed layer positioned adjacent to the first spacer layer;

a second plurality of cavities equal in number to the radiating elements and configured on a second spacer layer, the second spacer layer positioned adjacent to the transmission feed layer; and a ground plane comprising a copper clad surface on a ground plane layer, the ground plane layer positioned adjacent the second spacer layer.

9. The cross slot broad band antenna as in claim 8, wherein the transmission feed layer comprises a lossy material having a loss tangent of no more than 0.04.

10. The cross slot broad band antenna as in claim 8, wherein the radiating cross slot layer includes a copper clad surface opposite a radiating surface.

11. The cross slot broad band antenna as in claim 8, wherein the plurality of radiating slots comprises a bow tie configuration.

12. The cross slot broad band antenna as in claim 8, wherein each of the plurality of radiating elements comprises a diamond-shaped configuration.

13. The cross slot broadband antenna as in claim 8, wherein the suspended transmission lines each comprise a dual conductor, the conductors of each transmission line support on the opposite side of the transmission feed layer.

14. The cross slot broadband antenna as in claim 8, further comprising mode suppression connectors interconnecting the radiating cross slot layer, the first and second spacer layers, the transmission feed layer and the ground plane layer, the mode suppression connectors configured to define the boundaries of each of the plurality of radiating elements.

15. The cross slot broadband antenna as in claim 8, wherein each of the plurality of first cavities and each of the plurality of second cavities comprise a propagation structure for the suspended transmission lines.

* * * * *